US006687470B2

(12) United States Patent
Shim et al.

(10) Patent No.: US 6,687,470 B2
(45) Date of Patent: Feb. 3, 2004

(54) METHOD OF COMPENSATING FOR IMAGE QUALITY BY CONTROLLING TONER REPRODUCTION CURVE

(75) Inventors: Woo-jung Shim, Gyeonggi-do (KR); Seung-deog An, Gyeonggi-do (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/200,972

(22) Filed: Jul. 24, 2002

(65) Prior Publication Data

US 2003/0147660 A1 Aug. 7, 2003

(30) Foreign Application Priority Data

Jan. 31, 2002 (KR) ..... 2002-5649

(51) Int. Cl.[7] ..... G03G 15/00

(52) U.S. Cl. ..... 399/49; 399/46; 399/50; 399/53

(58) Field of Search ..... 399/49

(56) References Cited

U.S. PATENT DOCUMENTS 5,717,978 A * 2/1998 Mestha ..... 399/46
5,767,888 A * 6/1998 Schleusener et al. ..... 347/130
5,839,022 A 11/1998 Wang et al.
6,035,152 A * 3/2000 Craig et al. ..... 399/49
6,101,357 A * 8/2000 Wayman ..... 399/266

* cited by examiner

*Primary Examiner*—Quana M. Grainger
(74) *Attorney, Agent, or Firm*—Staas & Halsey LLP

(57) ABSTRACT

A method of compensating for image quality controls a toner reproduction curve (TRC). The toner reproduction curve TRC $\Phi(k)$ measured by a color toner density sensor is compared with a target TRC $\Phi_R$ to obtain a deviation $\Delta\Phi$. A variation $\Delta V_B$ of a developer bias $V_B$ is calculated from a Jacobian matrix ($J_B$) of a measured developer bias $V_B$ to calculate a new developer bias $V_{BN}$ and determining a measured grid voltage $V_G$ as a new grid voltage $V_{GN}$ if the deviation ($\Delta\Phi$) is greater than a tolerance $\Delta\Phi_T$. A backplating vector $V_{BP}$ is obtained from the grid voltage $V_{GN}$ and the developer bias $V_{BN}$. The backplating vector $V_{BP}$ is compared with a critical value $V_T$ to set control parameters $V_{GN}$ and $V_{BN}$ and control the TRC $\Phi$. Thus, noise effects on the image quality are minimized to provide an output image closest to an input image quality so as to improve the image quality.

35 Claims, 12 Drawing Sheets

METHOD OF COMPENSATING FOR IMAGE QUALITY BY CONTROLLING TONER REPRODUCTION CURVE

CROSS-REFERENCE TO RELATED APPLICATIONS

This application claims the benefit of Korean Patent Application No. 2002-5649, filed Jan. 31, 2002, in the Korean Industrial Property Office, the disclosure of which is incorporated herein by reference.

BACKGROUND OF THE INVENTION

1. Field of the Invention

The present invention relates to a method of compensating for image quality of a printing machine, and more particularly, to a method of compensating for image quality to provide a high quality image by effectively controlling a toner reproduction curve (TRC) to cope with environmental changes.

2. Description of the Related Art

An electrophotographic process used in a printing machine generally includes an initial step of charging a surface of a photoconductor. The charged surface of the photoconductor is exposed to light to form a latent electrostatic image in a specific image area. A develop unit controls a developing solution to adhere to the latent electrostatic image to develop the latent electrostatic image. The developed image is transferred to paper. The transferred image is fixed on the paper by a fixing roller.

In the step of charging the surface of the photoconductor, the photoconductor is charged with a uniform (constant) charge voltage so as to improve the quality of a printed image. Thus, the charge voltage charged on the photoconductor needs to be controlled to be uniform (constant). If the charge voltage is low, pollutants may occur in a non-image area. If the charge voltage is high, developed mass of the developing solution is changed. If the charge voltage is excessive, the photoconductor can become permanently damaged.

The charge voltage of the photoconductor is strengthened (modified) to a predetermined voltage, so-called "exposure voltage," to form the latent electrostatic image in the exposure step. The developer unit has a developer bias so that a development voltage of the developing solution is higher than the exposure voltage of a portion on which the latent electrostatic image is formed, and lower than a non-image voltage of another portion of a photosensitive belt on which the latent electrostatic image is not formed. Due to this, a development step of adsorbing the developing solution to the latent electrostatic image may further be performed.

The developed mass of the developing solution absorbed in the latent electrostatic image is affected due to the exposure voltage and a development voltage as well as the charge voltage as described above.

A deviation (difference) between the development voltage and the exposure voltage becomes too big when the exposure voltage is low even though the uniform development voltage is applied. As a result, the adsorption of the developing solution increases. In contrast, the deviation between the development voltage and the exposure voltage is small when the exposure voltage is high even though the uniform development voltage is applied, thereby decreasing the adsorption of the developing solution. As a result, the developed image fades.

According to the above-described principle, when the photoconductor, which is charged with a predetermined charge voltage and a predetermined exposure voltage, is overcharged with the development voltage, a big deviation between the development voltage and the exposure voltage causes the developing solution to be excessively adsorbed on (attached to) the surface of the photoconductor. In contrast, the photoconductor is undercharged with the development voltage, a small deviation between the development voltage and the exposure voltage causes a relatively small amount of the adsorption of the developing solution on the photoconductor. As a result, the developed image fades.

Accordingly, efforts to develop an algorithm for properly controlling the charge voltage, the exposure voltage, and the development voltage have been made to compensate for the image quality. There was proposed a conventional method of compensating for the image quality by measuring the developed mass of an image on a photosensitive belt to control the printing machine since the above-mentioned three voltages affect the developed mass of the image.

FIG. 1 is a block diagram illustrating a conventional printing machine performing a method of controlling developed mass per unit area (DMA) to compensate for image errors so as to obtain a high quality image, which is disclosed in U.S. Pat. No. 5,749,021. The method suggests controlling the charge voltage, the exposure voltage, and the developer bias from internal process parameters, i.e., a discharge ratio, a cleaning voltage, and a development voltage.

The method of controlling the DMA improves the print quality by keeping the DMA under control in process control loops. Areas on which images are formed on a photoconductor are called "image areas," and test patches are generally prepared in a zone between the image areas of the photoconductor to be used for measuring the DMA. After the measured DMA is compared with a target value, errors are transmitted to a controller to control the internal process parameters so as to compensate for development errors. In other words, a grid voltage of a charger and an average beam power of an exposure system can be calculated from the internal process parameters to control subsystems of the printing machine.

Referring to FIG. 1, a level 1 controller 120 of a development system 140 transmits proper control signals $U_g$ and $U_l$ to an electrostatic charging and exposure system 122.

An electrostatic voltage sensor (ESV) measures a voltage of the electrostatic charging and exposure system 122 to obtain electrostatic and exposure voltage values $V_h$ and $V_l$ 124, respectively. The comparators 126*a* and 126*b* compare ESV sensor values $V_h$ and $V_l$ 124 with target values $V_h^T$ and $V_l^T$ 128 of the electrostatic and exposure voltage values $V_h$ and $V_l$ 124 to provide error signals $E_h$ and $E_l$ 129 to the level 1 controller 120. Gains of level 1 loops are obtained from the error signals $E_h$ and $E_l$ 129 to converge the voltage of the photoconductor to the target values $V_h^T$ and $V_l^T$ 128.

A level 2 controller 130 generates the target values $V_h^T$ and $V_l^T$ 128 to obtain the electrostatic and exposure voltage values $V_h$ and $V_l$ 124 through the level 1 controller 1 and the electrostatic charging and exposure system 122. Comparators 136*a* and 136*b* compare DMA sensor values $D_l$, $D_m$, and $D_h$ 134, which are measured by a color toner density (CTD) sensor from the test patches prepared according to a toner area coverage, with target values $D_l^T$, $D_m^T$, and $D_h^T$ 138, respectively, to provide error signals 139 to the level 2 controller 130. The level 2 controller 130 also generates a signal $V^T_d$ to control a development system 132.

In other words, in the method of controlling the DMA, the DMA sensor values $D_l$, $D_m$, and $D_h$ 134 measured by the CTD sensor are compared with the target values $D_l^T$, $D_m^T$, and $D_h^T$ 138 to calculate deviations (differences) thereof. Thereafter, the calculated deviations are provided to the level 2 controller 130 to make the deviations linear with respect to the internal process parameters, i.e., the discharge ratio, the cleaning voltage, and the developer bias. Control parameters, i.e., the target values of the charging voltage, the exposure voltage, and the developer bias, are extracted from the linear discharge ratio, the cleaning voltage, and the developer bias to control the level 1 controller 120, the electrostatic charging and exposure system 122, and the development system 132. This control process will now be described with reference to FIG. 2.

FIG. 2 is a flowchart explaining the method of controlling the DMA in the printing machine of FIG. 1. Referring to FIG. 2, in the method of controlling the DMA, the DMA value is measured in step 101. Next, the measured DMA value is compared with the target DMA value to calculate a deviation thereof in step 103. If the deviation is smaller than a tolerance, a printing job is performed. If the deviation is greater than the tolerance, a control parameter displacement mass ΔU is calculated by equation 1 in step 107. A new control parameter Unew is set by equation 2 to control the DMA in step 109.

$$\Delta U = -G \cdot \Delta D \tag{1}$$

$$U_{NEW} = U_{OLD} + \Delta U \tag{2}$$

The method of controlling the DMA as shown in FIG. 2 has a poor development control problem in the printing machine. The reason is that the DMA value measured by the CTD sensor contains noise components as well as the DMA value in the developer system. These noise components occur due to pollutants disposed on an organic photoconductive cell (OPC) or an intermediate transfer belt (ITB), a non-linearity of development characteristics, and other external disturbances.

When the control parameter displacement mass ΔU of the control parameters is calculated to control the DMA, the deviation ΔD between the target DMA value and the measured DMA value is multiplied by a gain matrix G to calculate the control parameter displacement mass ΔU of the control parameters. Here, as seen in equation 3, the noise components are also multiplied to affect the control parameter displacement mass ΔU of the control parameters.

$$\Delta U = G \cdot (\Delta D + n) \tag{3}$$

Due to this multiplied noise components, if errors occur in the control parameter displacement mass ΔU of the control parameter and if noise is great, the DMA cannot be controlled. If serious, the calculated control parameters become out of operative areas so as not to properly compensate for the image quality.

SUMMARY OF THE INVENTION

To solve the above and other problems, it is an object of the present invention to provide a method of compensating for image quality to obtain a high quality image by controlling a uniform toner reproduction curve (TRC) so as to exclude noise components that may be contained in measured DMA value.

Additional objects and advantageous of the invention will be set forth in part in the description which follows and, in part, will be obvious from the description, or may be learned by practice of the invention.

Accordingly, to achieve the above and other objects, a method of compensating for image quality of an printing machine having a color toner density sensor, which is provided over a photosensitive belt, includes receiving light reflected from test patches each having a different toner area coverage and converting the received light to an electrical signal to control a developer bias $V_B$ and a grid voltage $V_G$. The method includes: (a) comparing a toner reproduction curve (TRC) Φ(k) value measured by the color toner density sensor with a target TRC value $\Phi_R$ to obtain a deviation ΔΦ; (b) calculating a variation $\Delta V_B$ of the developer bias $V_B$ from a Jacobian matrix ($J_B$) of a measured developer bias $V_{BO}$ to calculate a developer bias control parameter $V_{BN}$ and determining a measured grid voltage $V_{GO}$ as a grid voltage control parameter $V_{GN}$ if the deviation (ΔΦ) is greater than tolerance $\Delta\Phi_T$; (c) obtaining a backplating vector $V_{BP}$ from the grid voltage control parameter $V_{GN}$ and the developer bias control parameter $V_{BN}$; and (d) comparing the backplating vector $V_{BP}$ with a critical value $V_T$ to set the grid voltage control parameter $V_{GN}$ and the developer bias control parameter $V_{BN}$ as new control parameters $V_{GN}$ and $V_{BN}$ to control a TRC Φ, the developer bias $V_B$, and the grid voltage $V_G$.

In operation (a), the deviation ΔΦ satisfies equation 4.

$$\Delta\Phi = |\Phi_O - \Phi_T| \tag{4}$$

$$\text{where } \Phi_o = \begin{bmatrix} \Phi_{OL} \\ \Phi_{OM} \\ \Phi_{OH} \end{bmatrix} \text{and } \Phi_T = \begin{bmatrix} \Phi_{TL} \\ \Phi_{TM} \\ \Phi_{TH} \end{bmatrix}.$$

Operation (b) includes: (b-1) calculating the variation $\Delta V_B$ of the developer bias $V_B$, which satisfies equation 5, from the Jacobian matrix $J_B$ of the measured developer bias $V_B$;

$$\Delta V_B = -G_B \cdot \Delta\Phi \tag{5}$$

$$\text{where } G_B = (J_B^T \cdot J_B)^{-1} \cdot J_B^T \text{ and where } J_B = \begin{bmatrix} J_{BL} \\ J_{BM} \\ J_{BH} \end{bmatrix} = \begin{bmatrix} 2A'_L V_B + F'_L V_G + C'_L \\ 2A'_M V_B + F'_M V_G + C'_M \\ 2A'_H V_B + F'_H V_G + C'_H \end{bmatrix} = \begin{bmatrix} \frac{\partial \Phi_{OL}}{\partial V_B} \\ \frac{\partial \Phi_{OM}}{\partial V_B} \\ \frac{\partial \Phi_{OH}}{\partial V_B} \end{bmatrix}$$

(b-2) setting a new developer bias control parameter $V_{BN}$, which satisfies equation 6, from the variation $\Delta V_B$ of the developer bias $V_B$; and $$V_{BN} = V_B + \Delta V_B \tag{6}$$

(b-3) determining the measured grid voltage $V_G$ as a new grid voltage $V_{GN}$.

In operation (c), the backplating vector $V_{BP}$, which satisfies equation 7, is calculated from the new grid voltage control parameter $V_{GN}$ and the new developer bias control parameter $V_{BN}$.

$$V_{BP} = V_{GN} - V_{BN} \tag{7}$$

Operation (d) includes: (d-1) determining the new grid voltage control parameter $V_{GN}$ and the new developer bias control parameter $V_{BN}$ in operation (c) as control parameters if the backplating vector $V_{BP}$ is greater than the critical value $V_T$; (d-2) calculating the developer bias control parameter $V_{BN}$ and the grid voltage control parameter $V_{GN}$, which satisfy equation 8, from the Jacobian matrix $J_B$ of the measured developer bias $V_{BO}$, Jacobina matrix $J_G$ of the measured grid voltage $V_{GO}$, and a TRC control parameter C if the backplating vector $V_{BP}$ is smaller than the critical value $V_T$;

$$V_{BN}=V_B+\Delta V_B$$
$$V_{GN}=V_G+\Delta V_G \tag{8}$$

where $\Delta V_B=-G_B\cdot\Delta\Phi\cdot(I+C)$ and $\Delta V_G=-G_G\cdot\Delta\Phi\cdot C$, where $G_G=(J_G^T\cdot J_G)^{-1}\cdot J_G^T$, and $$\text{where } J_G=\begin{bmatrix} J_{GL} \\ J_{GM} \\ J_{GH} \end{bmatrix}=\begin{bmatrix} 2B'_L V_G+E'_L V_V+D'_L \\ 2B'_M V_G+E'_M V_B+D'_M \\ 2B'_H V_G+E'_H V_B+D'_H \end{bmatrix}=\begin{bmatrix} \frac{\partial\Phi_{OL}}{\partial V_G} \\ \frac{\partial\Phi_{OM}}{\partial V_G} \\ \frac{\partial\Phi_{OH}}{\partial V_G} \end{bmatrix}$$

(d-3) increasing the TRC control parameter C by an increment a so as to satisfy equation 9 if the backplating vector $V_{BP}$ is smaller than the critical value $V_T$;

$$C=C+\alpha \tag{9}$$

(d-4) repeating operation (d-3) until the backplating vector $V_{BP}$ becomes greater than the critical value $V_T$; and (d-5) determining the new grid voltage control parameter $V_{GN}$ and the new developer bias control parameter $V_{BN}$ as the new control parameters $V_{GN}$ and $V_{BN}$ when the backplating vector $V_{BP}$ is greater than the critical value $V_T$.

To achieve the above and other objects, a method of compensating for the image quality of an printing machine having a color toner density sensor, which is provided over a photosensitive belt, includes receiving light reflected from test patches with different toner area coverages and converting the received light to an electrical signal to control a develop bias $V_B$ and a grid voltage $V_G$. The method includes: (a) comparing a toner reproduction curve $\Phi(k)$ measured by the color toner density sensor with a reference TRC $\Phi_R$ to obtain a deviation $\Delta\Phi$; (b) calculating a variation $\Delta V_B$ of a developer bias $V_B(k)$ from a Jacobian matrix $J_B$ of a measured developer bias $V_B(k)$ to calculate a new developer bias control parameter $V_B(k+1)$ and determining a measured grid voltage $V_G(k)$ as a new grid voltage control parameter $V_G(k+1)$ if the deviation $\Delta\Phi$ is not less than a tolerant deviation $\Delta\Phi_T$; and (c) obtaining a backplating vector $V_{BP}$ from a difference between the grid voltage control parameter $V_G(k+1)$ and the developer bias control parameter $V_B(k+1)$.

The method further includes (d) initializing a control parameter a, comparing the backplating vector $V_{BP}$ with a minimum critical value $V_{Tmin}$, performing operation (e) if the backplating vector $V_{BP}$ is smaller than the minimum critical value $V_{Tmin}$, and performing operation (g) if the backplating vector $V_{BP}$ is greater than the minimum critical value $V_{Tmin}$; (e) increasing the control parameter "a" by an increment "α", setting the developer bias and grid voltage control parameters $V_G(k+1)$ and $V_B(k+1)$ based on an amount of the deviation $\Delta\Phi$, obtaining the backplating vector $V_{BP}$ from the difference between the grid voltage control parameter $V_G(k+1)$ and the developer bias control parameter $V_B(k+1)$, and performing operation (f); (f) repeating operations (e) if the backplating vector $V_{BP}$ is smaller than the minimum critical value $V_{Tmin}$, and repeating operations (a) through (e) if the backplating vector $V_{BP}$ is greater than the minimum critical value $V_{Tmin}$; (g) increasing the control parameter "a" by the increment "α", setting control parameters $V_G(k+1)$ and $V_B(k+1)$ based on an amount of the deviation $\Delta\Phi$, obtaining the backplating vector $V_{BP}$ from the difference between the control parameters $V_G(k+1)$ and $V_B(k+1)$, and performing operation (h); (h) repeating operation (g) if the backplating vector $V_{BP}$ is greater than a maximum critical value $V_{Tmax}$, and repeating operations (a) through (g) if the backplating vector $V_{BP}$ is smaller than a maximum critical value $V_{Tmax}$.

In operation (a), the deviation $\Delta\Phi$ satisfies equation 10.

$$\Delta\Phi=\Phi(k)-\Phi_R \tag{10}$$

$$\text{where } \Phi(k)=\begin{bmatrix} \Phi(k)_L \\ \Phi(k)_M \\ \Phi(k)_H \end{bmatrix} \text{and } \Phi_R=\begin{bmatrix} \Phi_{RL} \\ \Phi_{RM} \\ \Phi_{RH} \end{bmatrix}.$$

Operation (b) includes: (b-1) calculating the variation $\Delta V_B$ of the developer bias $V_B(k)$, which satisfies equation 11, from the Jacobian matrix $J_B$ of the measured developer bias $V_B(k)$;

$$\Delta V_B=-G_B\cdot\Delta\Phi \tag{11}$$

$$\text{Where } G_B=(J_B^T\cdot J_B)^{-1}\cdot J_B^T \text{ where}$$

$$J_B=\begin{bmatrix} J_{BL} \\ J_{BM} \\ J_{BH} \end{bmatrix}=\begin{bmatrix} 2A_L V_B+E_L V_G+C_L \\ 2A_M V_B+E_M V_G+C_M \\ 2A_H V_B+E_H V_G+C_H \end{bmatrix}=\begin{bmatrix} \frac{\partial\Phi(k)_L}{\partial V_B} \\ \frac{\partial\Phi(k)_M}{\partial V_B} \\ \frac{\partial\Phi(k)_H}{\partial V_B} \end{bmatrix}$$

(b-2) setting a new developer bias control parameter $V_B(k+1)$, which satisfies equation 12, from the variation of the developer bias control input value $\Delta V_B$ of the developer bias $V_B$; and $$V_B(k+1)=V_B(k)+\Delta V_B \tag{12}$$

(b-3) determining the measured grid voltage $V_G(k)$ as a new grid voltage control parameter $V_{GN}(k+1)$.

In operation (c), the backplating vector $V_{BP}$, which satisfies equation 13, is calculated from the grid voltage control parameter $V_G(k+1)$ and the developer bias control parameter $V_B(k+1)$.

$$V_{BP}=V_G(k+1)-V_B(k+1) \tag{13}$$

In operation (d), the control parameter "a" is initialized as "0".

Operation (e) includes: (e-1) incrementing the control parameter a by an increment "α" according to equation 14;

$$a=a+\alpha \tag{14}$$

(e-2) setting the control parameters $V_G(k+1)$ and $V_B(k+1)$ that satisfy equation 15 to obtain the backplating vector $V_{BP}$ from the difference between the grid voltage control parameter $V_G(k+1)$ and the developer bias control parameter $V_B(k+1)$ if the deviation $\Delta\Phi$ is negative and then going to operation (t); and $$V_B(k+1)=V_B(k)+\Delta V_B$$
$$V_G(k+1)=V_G(k)+\Delta V_G \tag{15}$$
$$V_{BP}=V_G(k+1)-V_B(k+1)$$

where $\Delta V_B=-G_B\cdot\Delta\Phi\cdot(1+a)$ and $\Delta V_G=G_G\cdot\Delta\Phi\cdot a$, where $G_G=(J_G^T\cdot J_G)^{-1}\cdot J_G^T$, and where $$J_G=\begin{bmatrix} J_{GL} \\ J_{GM} \\ J_{GH} \end{bmatrix}=\begin{bmatrix} 2B_LV_G+E_LV_B+D_L \\ 2B_MV_G+E_MV_B+D_M \\ 2B_HV_G+E_HV_G+D_H \end{bmatrix}=\begin{bmatrix} \frac{\partial\Phi(k)_L}{\partial V_G} \\ \frac{\partial\Phi(k)_M}{\partial V_G} \\ \frac{\partial\Phi(k)_H}{\partial V_G} \end{bmatrix},$$

(e-3) setting the control parameters $V_G(k+1)$ and $V_B(k+1)$ that satisfy equation 16 to obtain the backplating vector $V_{BP}$ from the difference between the grid voltage control parameter $V_G(k+1)$ and the developer bias control parameter $V_B(k+1)$ if the deviation $\Delta\Phi$ is positive and then going to operation (f); and $$\begin{aligned} V_B(k+1)&=V_B(k)+\Delta V_B \\ V_G(k+1)&=V_G(k)+\Delta V_G \\ V_{BP}&=V_G(k+1)-V_B(k+1) \end{aligned} \tag{16}$$

where $\Delta V_B=-G_B\cdot\Delta\Phi\cdot(1-a)$ and $\Delta V_G=-G_G\cdot\Delta\Phi\cdot a$, where $G_G=(J_G^T\cdot J_G)^{-1}\cdot J_G^T$, and $$\text{where } J_G=\begin{bmatrix} J_{GL} \\ J_{GM} \\ J_{GH} \end{bmatrix}=\begin{bmatrix} 2B_LV_G+E_LV_B+D_L \\ 2B_MV_G+E_MV_B+D_M \\ 2B_HV_G+E_HV_G+D_H \end{bmatrix}=\begin{bmatrix} \frac{\partial\Phi(k)_L}{\partial V_G} \\ \frac{\partial\Phi(k)_M}{\partial V_G} \\ \frac{\partial\Phi(k)_H}{\partial V_G} \end{bmatrix}.$$

Operation (g) includes: (g-1) incrementing the control parameter "a" by the increment $\alpha$; (g-2) setting the control parameters $V_G(k+1)$ and $V_B(k+1)$ that satisfy equation 17 to obtain the backplating vector $V_{BP}$ from a difference between the grid voltage control parameter $V_G(k+1)$ and the developer bias control parameter $V_B(k+1)$ if the deviation ($\Delta\Phi$) is negative and then going to operation (h); and $$\begin{aligned} V_B(k+1)&=V_B(k)+\Delta V_B \\ V_G(k+1)&=V_G(k)+\Delta V_G \\ V_{BP}&=V_G(k+1)-V_B(k+1) \end{aligned} \tag{17}$$

where $\Delta V_B=-G_B\cdot\Delta\Phi\cdot(1-a)$ and $\Delta V_G=G_G\cdot\Delta\Phi\cdot a$, where $G_G=(J_G^T\cdot J_G)^{-1}\cdot J_G^T$and where $$J_G=\begin{bmatrix} J_{GL} \\ J_{GM} \\ J_{GH} \end{bmatrix}=\begin{bmatrix} 2B_LV_G+E_LV_B+D_L \\ 2B_MV_G+E_MV_B+D_M \\ 2B_HV_G+E_HV_G+D_H \end{bmatrix}=\begin{bmatrix} \frac{\partial\Phi(k)_L}{\partial V_G} \\ \frac{\partial\Phi(k)_M}{\partial V_G} \\ \frac{\partial\Phi(k)_H}{\partial V_G} \end{bmatrix}$$

(g-3) setting the control parameters $V_G(k+1)$ and $V_B(k+1)$ that satisfy equation 18 obtain the backplating vector $V_{BP}$ from the difference between the grid voltage control parameter $V_G(k+1)$ and the developer bias control parameter $V_B(k+1)$ if the deviation $\Delta\Phi$ is positive and then going to operation (f); and $$\begin{aligned} V_B(k+1)&=V_B(k)+\Delta V_B \\ V_G(k+1)&=V_G(k)+\Delta V_G \\ V_{BP}&=V_G(k+1)-V_B(k+1) \end{aligned} \tag{18}$$

where $\Delta V_B=-G_B\cdot\Delta\Phi\cdot(1-a)$ and $\Delta V_G=+G_G\cdot\Delta\Phi\cdot a$, where $G_G=(J_G^T\cdot J_G)^{-1}\cdot J_G^T$, and $$\text{where } J_G=\begin{bmatrix} J_{GL} \\ J_{GM} \\ J_{GH} \end{bmatrix}=\begin{bmatrix} 2B_LV_G+E_LV_B+D_L \\ 2B_MV_G+E_MV_B+D_M \\ 2B_HV_G+E_HV_G+D_H \end{bmatrix}=\begin{bmatrix} \frac{\partial\Phi(k)_L}{\partial V_G} \\ \frac{\partial\Phi(k)_M}{\partial V_G} \\ \frac{\partial\Phi(k)_H}{\partial V_G} \end{bmatrix}.$$

In the present invention, a high quality image can be provided by uniformly maintaining the toner reproduction curve in spite of external disturbances and changes of internal systems to uniformly control the developed mass per unit area regardless of noise components contained in the developed mass per unit area.

BRIEF DESCRIPTION OF THE DRAWINGS

These and other objects and advantageous of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
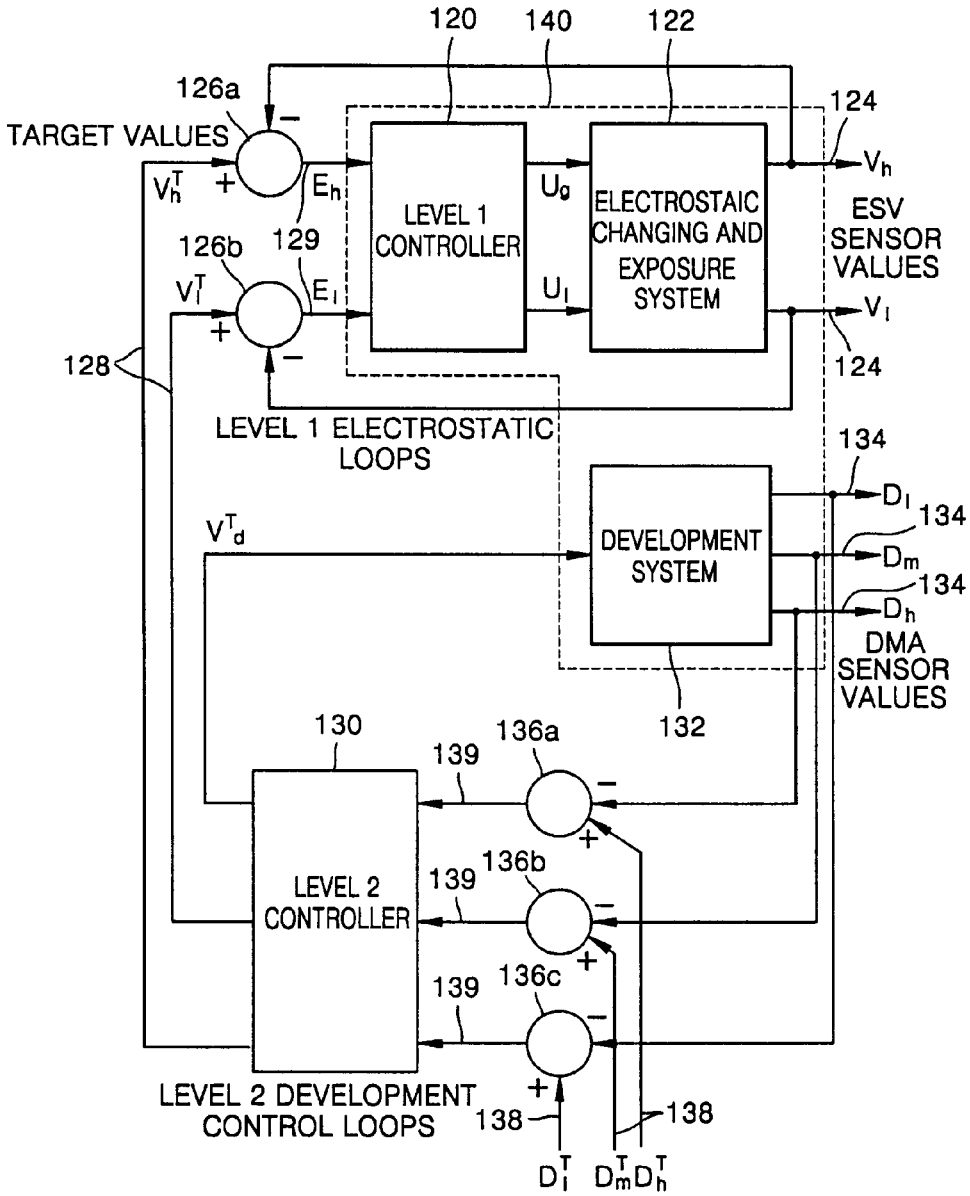
FIG. 1 (PRIOR ART)
FIG. 1 is a block diagram illustrating a conventional printing machine performing a method of controlling a developed mass per unit area (DMA) to compensate for image errors.
Figure 2:
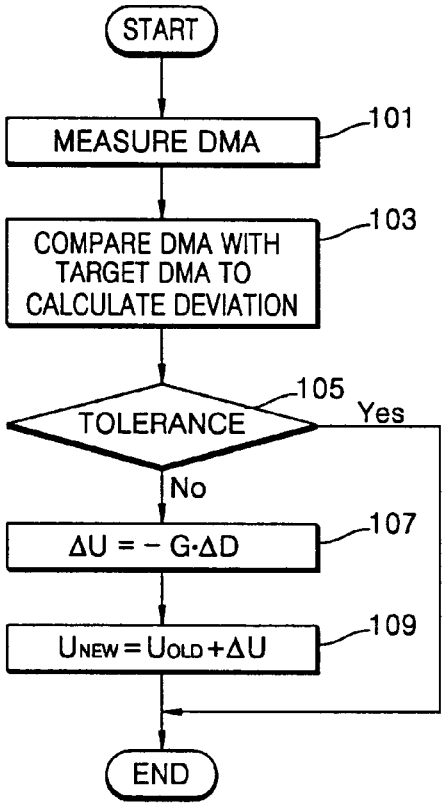
FIG. 2 (PRIOR ART)
FIG. 2 is a flowchart explaining the method of controlling the DMA in the printing machine of FIG. 2.

Reference will now be made in detail to the present preferred embodiments of the present invention, examples of which are illustrated in the accompanying drawings, wherein like reference numerals refer to the like elements throughout. The embodiments are described in order to explain the present invention by referring to the figures.

Hereinafter, a method of compensating for image quality according to an embodiment of the present invention will now be described in detail with reference to the attached drawings.

Figure 3:
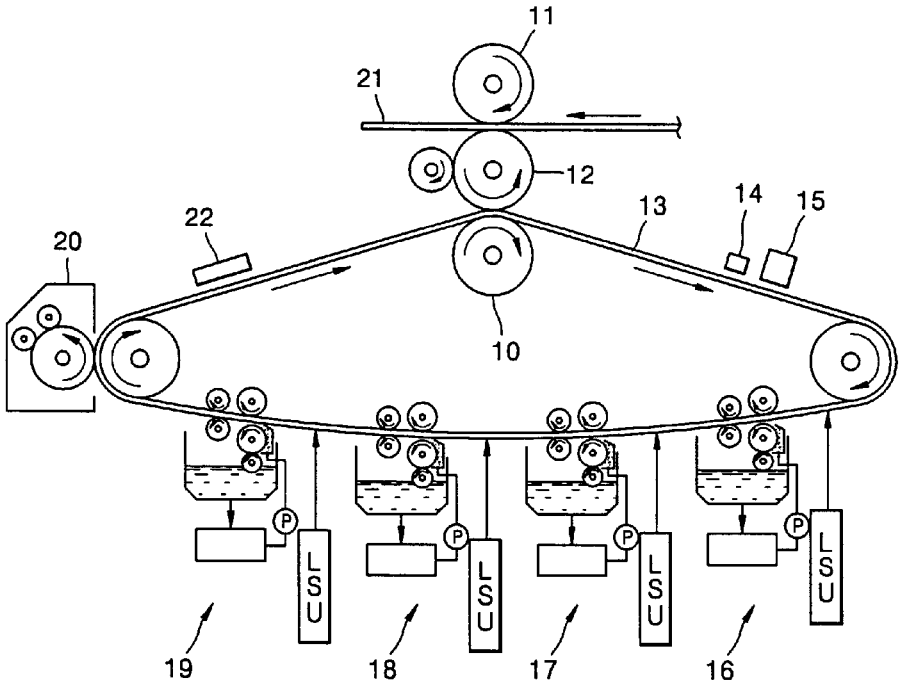
FIG. 3 is a schematic view of a general printing machine adopting a method of compensating for image quality according to an embodiment of the present invention.

FIG. 3 is a schematic view of a printing machine adopting a method of compensating for the image quality. Referring to FIG. 3, the printing machine includes a charger 15, laser scanning units (LSUs), developer units 16, 17, 18, and 19, a dryer 20, a color toner density (CTD) sensor 22, a first transfer roll 10, a second transfer roller 11, an intermediate transfer roller 12, and an eraser 14. Here, the charger 15 charges a surface of a photoconductor of a photosensitive belt 13 to a predetermined potential. The LSUs radiate light to the charged surface of the photoconductor to form latent electrostatic images thereon. The developer units 16, 17, 18, and 19 attach (transfer) a developing solution having colors of yellow (Y), cyan (C), magenta (M), and black (BK) to exposed portions of the photoconductor to develop the latent electrostatic images. The dryer 20 removes a carrier from the developed portions.

The CTD sensor 22 radiates infrared rays (light) onto test patches disposed and developed on the photosensitive belt 13 and measures the strength of reflected light from the test patches to generate an electrical signal proportional to developed mass per unit area (DMA). The first transfer roller 10 transfers the latent electrostatic images developed on the photosensitive belt 13 to the intermediate transfer roller 12 that contacts the photosensitive belt 13. The second transfer roller 11 and the intermediate transfer roller 12 form a fuser roller unit transferring the developed latent electrostatic images on the intermediate transfer roller 12 to paper 21. The eraser 14 reduces and uniformly maintains a voltage of the photoconductor after the transfer of the developed latent electrostatic images.

Figure 4:
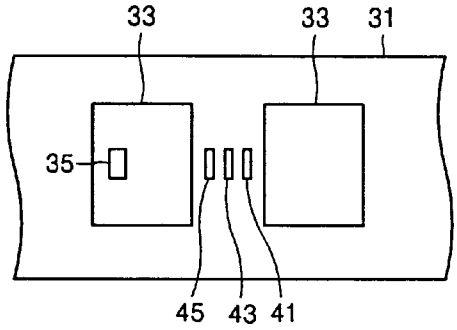
FIG. 4 is a schematic view of a photosensitive belt having test patches used for the method of compensating for the image quality in the printing machine of FIG. 3.

FIG. 4 is a schematic view of a photosensitive belt having test patches used for the method of compensating image quality according to the embodiment of the present invention. Referring to FIG. 4, a photosensitive belt 31 includes two image areas 33 which are separated from each other. Test patches 41, 43, and 45 each having a predetermined desired density are prepared in a zone between the image areas 33, charged by charger 15, and developed by the developer units in response to the predetermined desired density. The patches 41, 43, and 45 are created, one at high area coverage (90% to 100%), one at mid tone (around 50%), and one at low area coverage (0 to 20%), respectively.

A CTD sensor 35 is spaced apart from the photosensitive belt 31 to radiate infrared rays (light) onto the test patches 41, 43, and 45 and to measure the reflected light. Among signals detected by the CTD sensor 35 in response to the measured reflected light, toner reproduction curve (TRC) signals (values) detected from the test patches 41, 43, and 45 at the high area coverage, the mid tone, and the low area coverage are $T_H$, $T_M$, and $T_L$, respectively.

The CTD sensor 35 can optically measure an actual density of the developing solution adhering (attached) to the patches 41, 43, and 45. The more high density of the developing solution on the test patches 41, 43, and 45, the more light absorbed by the test patches 41, 43, and 45. Thus, if the respective test patches 41, 43, and 45 are detected through an optical sensor, the test patches 41, 43, and 45 appear dark depending on the density of the developing solution.

As described above, the CTD sensor 35 measures the intensity of the light reflected from the test patches 41, 43, and 45 to generate electrical signals proportional thereto. As the density of the developing solution increases, i.e., toner area coverage increases, the generation of the electrical signals decreases. Thus, a relationship equation such as equation 19 is achieved.

$$T_H<T_M<T_L \tag{19}$$

Figure 5:
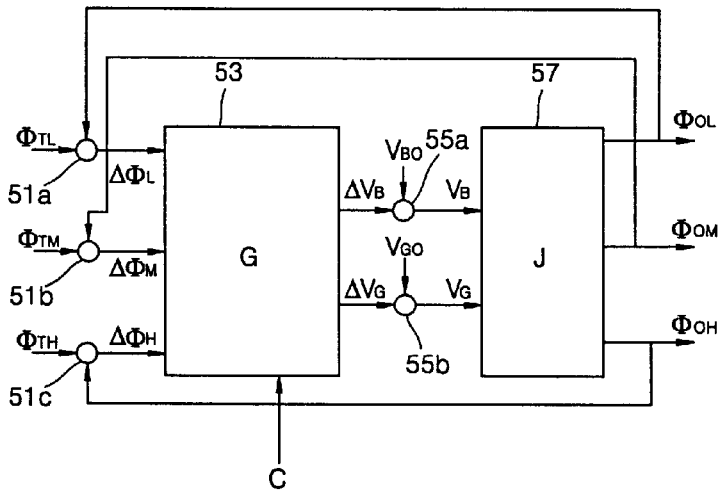
FIG. 5 is a block diagram illustrating a comparator and a development subsystem in the printing machine of FIG. 3.

FIG. 5 is a block diagram illustrating a portion of the printing machine employing the method of compensating for the image quality by controlling the TRC . Referring to FIG. 5, three comparators 51*a*, 51*b* and 51*c* compare measured TRC values $\Phi_{OL}$, $\Phi_{OM}$, and $\Phi_{OH}$ with target TRC values $\Phi_{TL}$, $\Phi_{TM}$, and $\Phi_{TH}$, respectively, to calculate deviations (differences) $\Delta\Phi_L$, $\Delta\Phi_M$, and $\Delta\Phi_H$. A compensator 53 obtains (generates) developer bias and grid voltage control input values $\Delta V_B$ and $\Delta V_G$ with respect to a developer bias $V_B$ and a grid voltage $V_G$ from a gain (coefficient) matrix G with respect to a specific TRC control parameter C and the deviations $\Delta\Phi_L$, $\Delta\Phi_M$, and $\Delta\Phi_H$.

Adders 55*a* and 55*b* add the control input values $\Delta V_B$ and $\Delta V_G$ to a measured developer bias $V_{BO}$ and a measured grid potential $V_{GO}$ to obtain a new developer bias $V_B$ and a new grid potential $V_G$, respectively. A development subsystem 57 calculates a backplating vector $V_{BP}$ from the developer bias $V_B$ and the grid voltage $V_G$, compares the backplating vector $V_{BP}$ with a target value $V_T$, and provides the developer bias $V_B$ and the grid potential $V_G$ to the printing machine to compensate for the image quality or calculate the new developer bias $V_B$ and the new grid potential $V_G$.

The printing machine is controlled by the developer bias $V_B$ and the grid potential $V_G$ so as to form an output image close to an input image.

Figure 6:
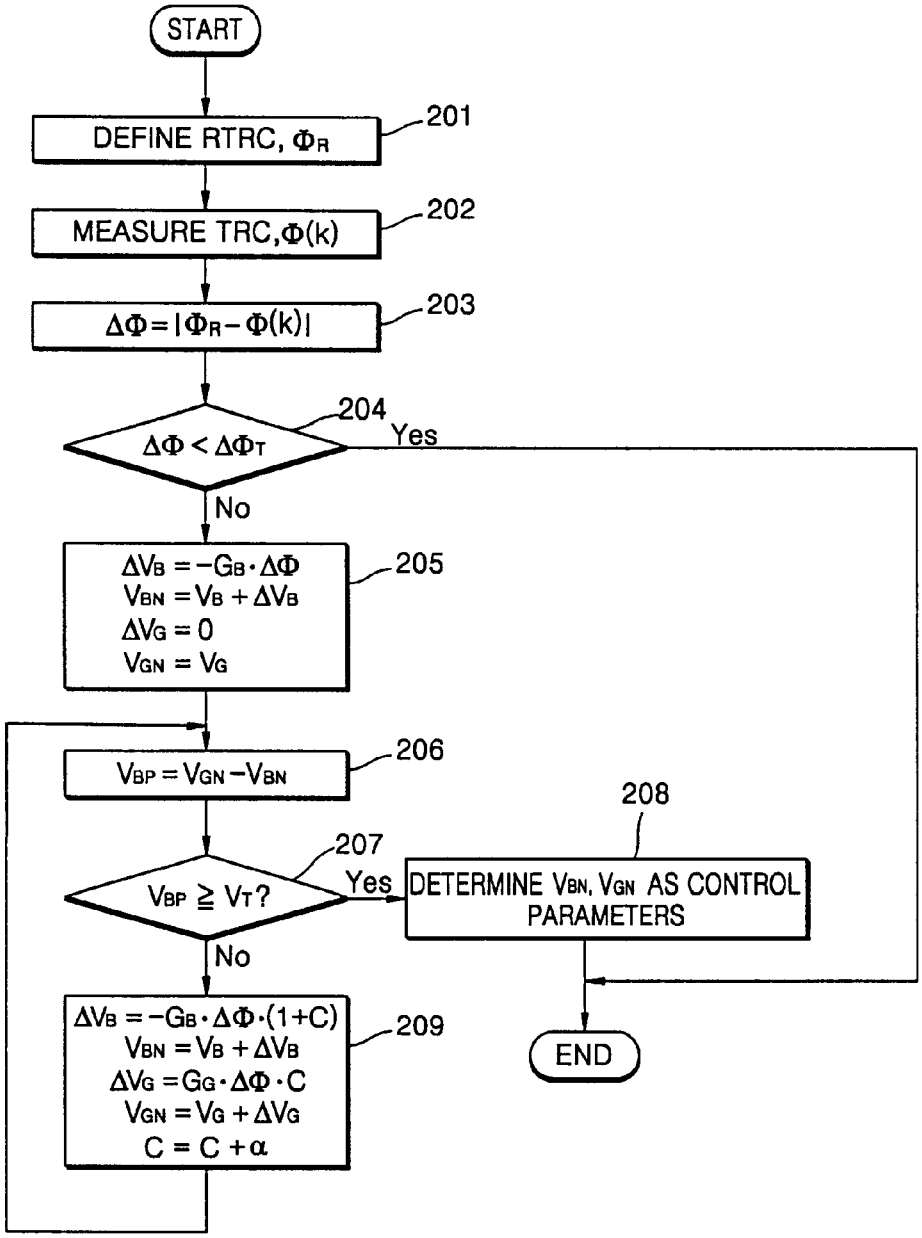
FIG. 6 is a flowchart of the method employed in the printing machine of FIGS. 3 through 5.

The method of compensating for the image quality according to this embodiment of the present invention will be described in more detail with reference to a flowchart shown in FIG. 6. Referring to FIG. 6, a CTD sensor measures a TRC value ($\Phi(k)$) on a photoconductor or an intermediate photosensitive belt in operation 202. A target TRC value ($\Phi_R$) is determined from a reference toner reproduction curve (RTRC) space in operation 201. The TRC value ($\Phi(k)$) is compared with the target TRC value ($\Phi_R$) to calculate a deviation thereof $\Delta\Phi$ using equation 4 in operation 203.

$$\Delta\Phi=|\Phi_O-\Phi_T| \tag{4}$$

$$\text{where } \Phi_o = \begin{bmatrix} \Phi_{OL} \\ \Phi_{OM} \\ \Phi_{OH} \end{bmatrix} \text{ and } \Phi_T = \begin{bmatrix} \Phi_{TL} \\ \Phi_{TM} \\ \Phi_{TH} \end{bmatrix}.$$

The deviation $\Delta\Phi$ is compared with a tolerance $\Delta\Phi_T$ in operation 204. If the deviation $\Delta\Phi$ is smaller than the tolerance $\Delta\Phi_T$, an operation of an algorithm of the method ends. If the deviation $\Delta\Phi$ is greater than the tolerance $\Delta\Phi_T$, the control input values $\Delta V_B$ and $\Delta V_G$ are calculated using equation 5, and then a new developer bias control parameter $V_{BN}$ and a new grid voltage control parameter $V_{GN}$ are calculated using equation 6 in operation 205.

$$\Delta V_B=-G_B\cdot\Delta\Phi \tag{5}$$

$$\text{where } G_B = (J_B^T \cdot J_B)^{-1} \cdot J_B^T \text{ and where}$$

-continued $$J_B = \begin{bmatrix} J_{BL} \\ J_{BM} \\ J_{BH} \end{bmatrix} = \begin{bmatrix} 2A'_L V_B + F'_L V_G + C'_L \\ 2A'_M V_B + F'_M V_G + C'_M \\ 2A'_H V_B + F'_H V_G + C'_H \end{bmatrix} = \begin{bmatrix} \frac{\partial \Phi_{OL}}{\partial V_B} \\ \frac{\partial \Phi_{OM}}{\partial V_B} \\ \frac{\partial \Phi_{OH}}{\partial V_B} \end{bmatrix}.$$

$$V_{BN}=V_B+\Delta V_B. \quad (6)$$

The backplating vector $V_{BP}$ is obtained from a difference between the developer bias control parameter $V_{BN}$ and the grid voltage control parameter $V_{GN}$ using equation 7 in operation 206. The backplating vector $V_{BP}$ is compared with a target value $V_T$ in operation 207. If the backplating vector $V_{BP}$ is greater than the target value $V_T$, the developer bias control parameter $V_{BN}$ and the grid voltage control parameter $V_{GN}$ are determined as control parameters to control the printing machine in operation 208. If the backplating vector $V_{BP}$ is smaller than the target value $V_T$, the TRC control parameter C is increased when equation 8 is used. The incremented TRC control parameter C and the control input values $\Delta V_B$ and $\Delta V_G$ are calculated from the deviation $\Delta\Phi$ and gain (Jacobian) matrixes $G_B$ and $G_B$ to obtain a new developer bias control parameter $V_{BN}$ and a new grid voltage control parameter $V_{GN}$. Operation 206 is repeated after operation 209 is performed.

$$V_{BP}=V_{GN}-V_{BN} \quad (7)$$

$$V_{BN}=V_B+\Delta V_B$$

$$V_{GN}=V_G+\Delta V_G \quad (8)$$

where $\Delta V_B=-G_B\cdot\Delta\Phi\cdot(I+C)$ and $\Delta V_G=-G_G\cdot\Delta\Phi\cdot C$ where $G_G=(J_G{}^T\cdot J_G)^{-1}\cdot J_G{}^T$ and $$\text{where } J_G = \begin{bmatrix} J_{GL} \\ J_{GM} \\ J_{GH} \end{bmatrix} = \begin{bmatrix} 2B'_L V_G + E'_L V_V + D'_L \\ 2B'_M V_G + E'_M V_B + D'_M \\ 2B'_H V_G + E'_H V_B + D'_H \end{bmatrix} = \begin{bmatrix} \frac{\partial \Phi_{OL}}{\partial V_G} \\ \frac{\partial \Phi_{OM}}{\partial V_G} \\ \frac{\partial \Phi_{OH}}{\partial V_G} \end{bmatrix}.$$

In operation 204, if the deviation $\Delta\Phi$ is greater than the tolerance $\Delta\Phi_T$, the control input value $\Delta V_B$ of the developer bias $V_B$ and the control input value $\Delta V_G$ of the grid voltage $V_G$ are not calculated at the same time. Rather, the control input value $\Delta V_G$ of the grid voltage $V_G$ is set to "0" and only the control input value $\Delta V_B$ of the developer bias $V_B$ is calculated to set new control parameters $V_{BN}$ and $V_{GN}$. This is to exclude (remove) noise components containable in the measured TRC value ($\Phi$(k)).

In operation 207, a new backplating vector $V_{BP}$ obtained from the difference between the control parameters $V_{BN}$ and $V_{GN}$ is smaller than the target value $V_T$, an operation of calculating new control parameters $V_{BN}$ and $V_{GN}$ as in operation 208 and comparing the new backplating vector $V_{BP}$ obtained from the difference between the new control parameters $V_{BN}$ and $V_{GN}$ with the target value $V_T$ is repeated.

Here, equation 9 is calculated using the TRC control parameter C because DMA $D_0$ is increased with an increase in the developer bias $V_B$, i.e., the TRC value is reduced, and DMA $_0$ is reduced with an increase in the grid voltage $V_G$, i.e., the TRC value is increased.

$$C=C+\alpha \quad (9)$$

Figure 7:
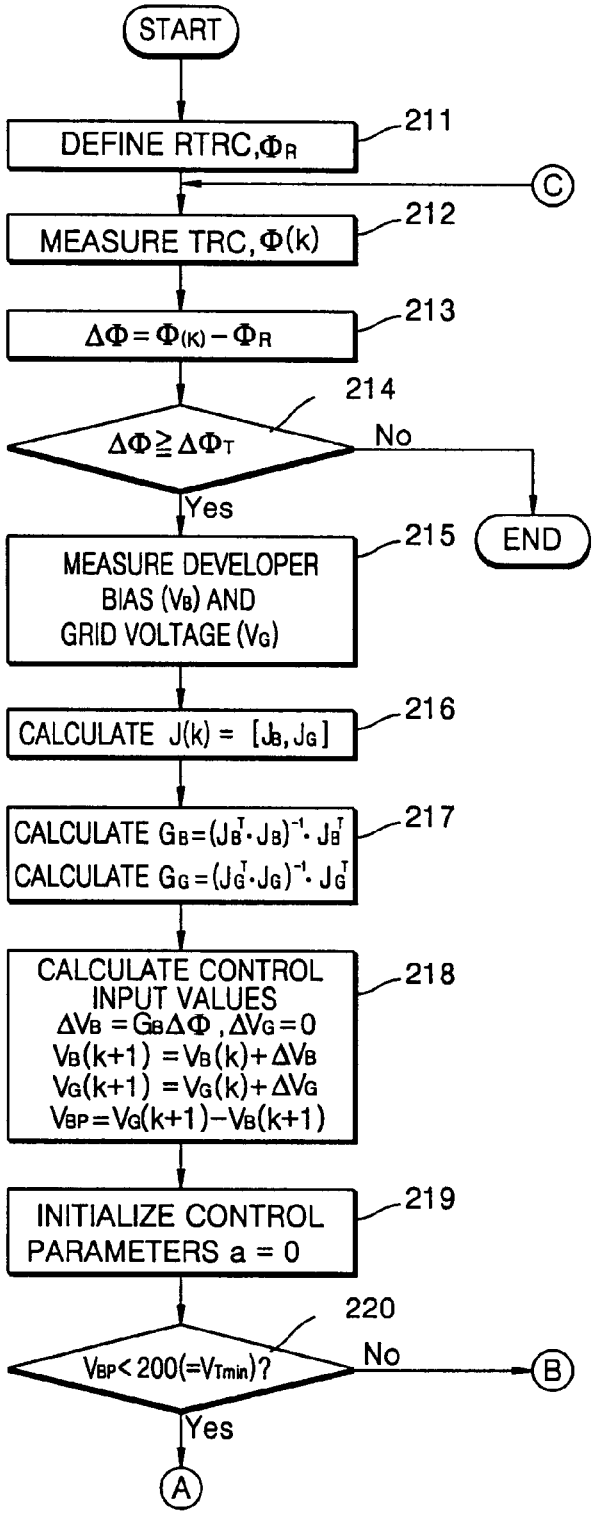
FIG. 7 is a flowchart of a method of compensating for the image quality according to another embodiment of the present invention.

FIG. 7 is a flowchart illustrating another method of compensating for the image quality according to another embodiment of the present invention. Referring to FIG. 7, the reference toner reproduction curve (RTRC) value is set and indicated by $\Phi_R$ in operation 211. The CTD sensor 22 on an intermediate photosensitive belt measures the TRC value which is indicated by $\Phi$(k) in operation 212.

The deviation $\Delta\Phi$ is calculated from a difference between the RTRC value $\Phi_R$ and the TRC value $\Phi$(k) in operation 213. The deviation $\Delta\Phi$ is compared with the tolerance $\Delta\Phi_T$, an operation of an algorithm of the method ends if the deviation $\Delta\Phi$ is smaller than the tolerance $\Delta\Phi_T$ in operation 214, and developer bias $V_B$ and grid voltage $V_G$ are calculated in operation 215 if the deviation $\Delta\Phi$ is greater than the tolerance $\Delta\Phi_T$.

A TRC characteristic equation is obtained from the developer bias $V_B$, the grid voltage $V_G$, and the TRC value $\Phi$(k), and the Jacobian matrixes are calculated from the TRC characteristic equation in operation 216.

In order to describe operations 211 through 216 in detail, the developer bias control input value $\Delta V_B$ and the grid voltage control input value $\Delta V_G$ are determined as parameters for control input values at ambient temperature and humidity using a photosensitive drum. Next, to obtain the TRC value ($\Phi$(k)), the CTD sensor 22 measures the TRC values when the toner area coverage is 20%, 50%, and 80%, respectively, from the developer bias $V_B$ and the grid voltage $V_G$ obtained from each of combinations of determined parameters.

The TRC values each having the toner area coverage of one of L (20%), M (50%), and H (80%) are represented by equation 20, respectively:

$$\Phi_L=\Phi_L(V_B, V_G)$$

$$\Phi_M=\Phi_M(V_B, V_G) \quad (20)$$

$$\Phi_H=\Phi_H(V_B, V_G)$$

If equation 20 is represented as a matrix, the TRC characteristic equation such as equation 21 is obtained.

$$\Phi=GU \quad (21)$$

$$\text{where } \Phi = \begin{bmatrix} \Phi_L \\ \Phi_M \\ \Phi_H \end{bmatrix}, G = \begin{bmatrix} A_L B_L C_L D_L E_L F_L \\ A_M B_M C_M D_M E_M F_M \\ A_H B_H C_H D_H E_H F_H \end{bmatrix},$$

$$\text{and } U = \begin{bmatrix} V^2{}_B \\ V^2{}_G \\ V_B \\ V_G \\ V_B \cdot V_G \\ 1 \end{bmatrix}.$$

The TRC values measured with respect to the developer bias $V_B$ and the grid voltage $V_G$ by the CTD sensor 22 are curve-fitted to calculate a coefficient matrix G of the TRC characteristic equation.

Jacobian matrix ($J=(J_B, J_G)$ with respect to the developer bias $V_B$ and the grid voltage $V_G$ can be represented by equation 22:

$$J=\begin{bmatrix}\frac{\partial\Phi_L}{\partial V_B} & \frac{\partial\Phi_L}{\partial V_G}\\ \frac{\partial\Phi_M}{\partial V_B} & \frac{\partial\Phi_M}{\partial V_G}\\ \frac{\partial\Phi_H}{\partial V_B} & \frac{\partial\Phi_H}{\partial V_G}\end{bmatrix}=\begin{bmatrix}J_{BL}J_{GL}\\ J_{BM}J_{GM}\\ J_{BH}J_{GH}\end{bmatrix} \tag{22}$$

where $J_{BL}=2A_LV_B+E_LV_G+C_L$, $J_{BM}=2A_MV_B+E_MV_G+C_M$, $J_{BH}=2A_HV_B+E_HV_G+C_H$, $J_{GL}=2B_LV_G+E_LV_{G+}D_L$, $J_{GM}=2B_MV_G+E_MV_G+D_M$, and $J_{GH}=2B_HV_G+E_HV_B+D_H$.

Figure 9A:
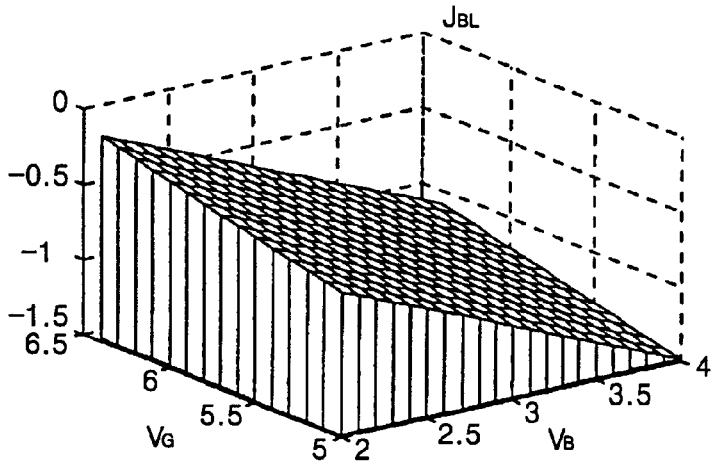
FIGS. 9A through 9C are graphs illustrating Jacobian matrixes $J_{BL}$, $J_{BM}$, and $J_{BH}$ of the method of FIGS. 7 though 8B.
Figure 9B:
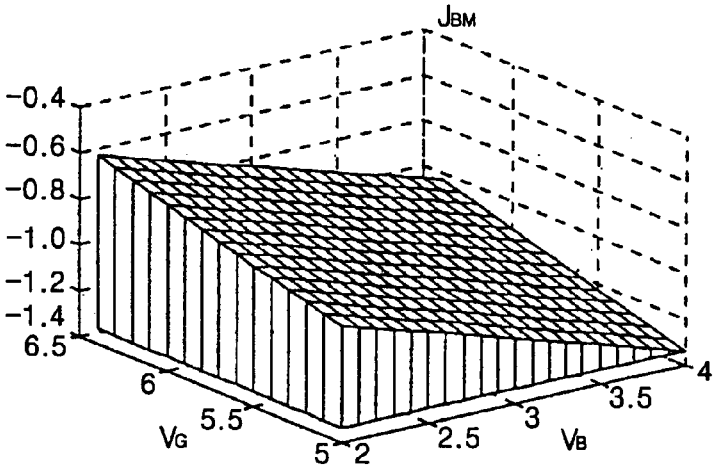
Figure 9C:
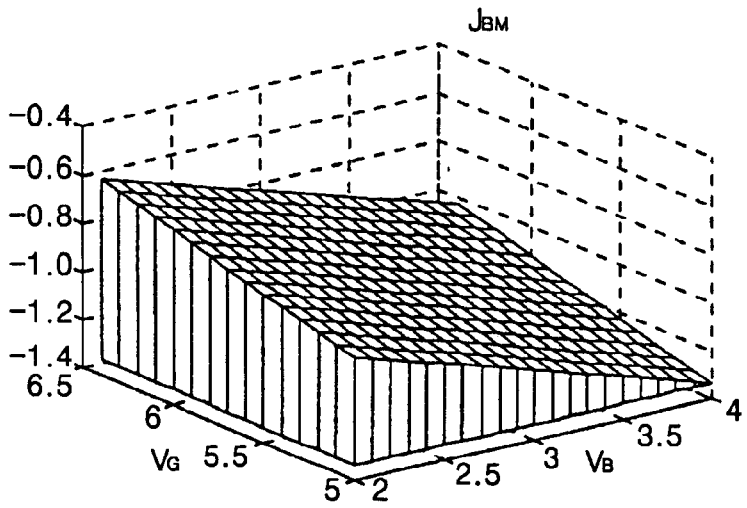
Figure 10A:
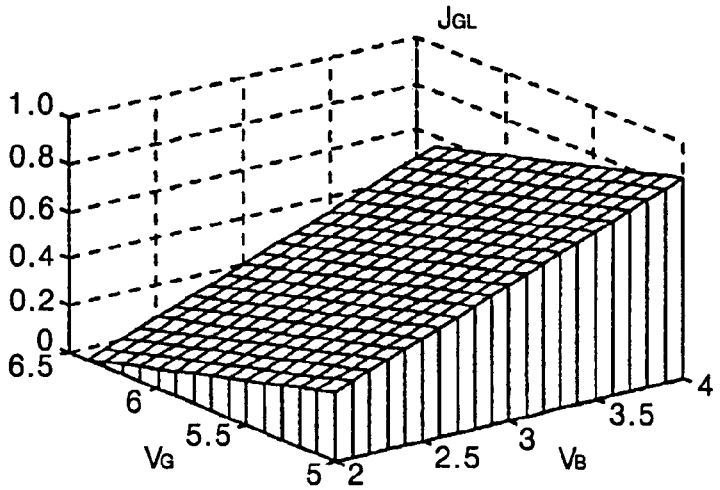
FIGS. 10A through 10C are graphs illustrating Jacobian matrixes $JG_L$, $J_{GM}$, and $J_{GH}$ of the method of FIGS. 7 through 8B.
Figure 10B:
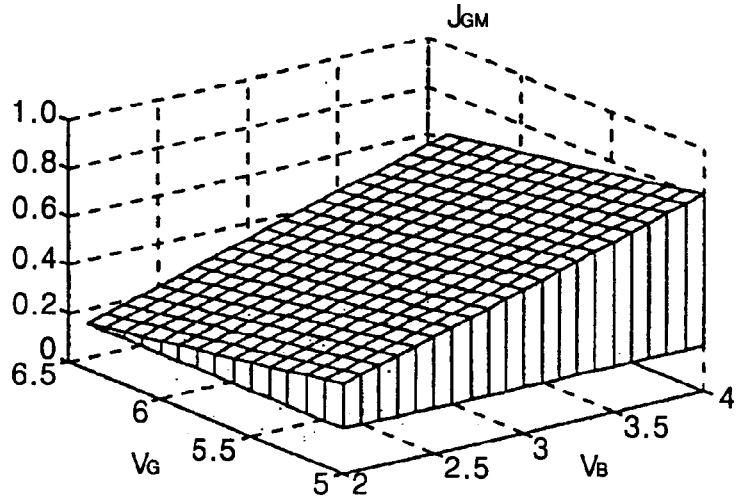
Figure 10C:
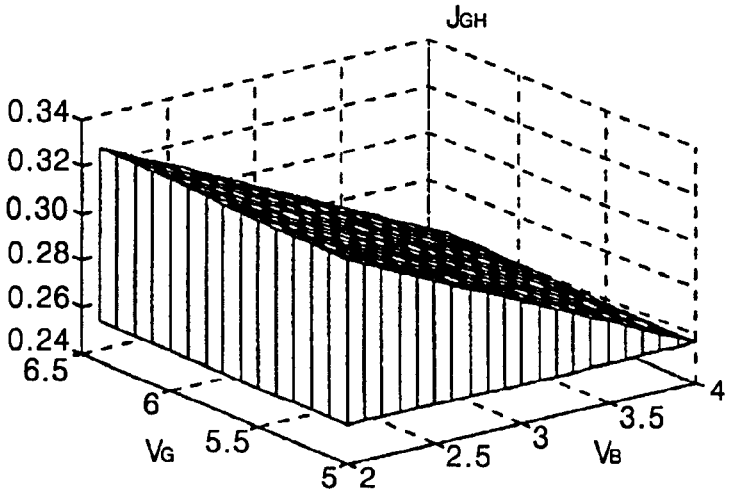

FIGS. 9A through 9C are graphs showing Jacobian matrixes $J_{BL}$, $J_{BM}$, and $J_{BH}$, which are measured using equation 22 after a CTD measures TRC according to the toner area coverage of the test patches 41, 43, and 45 shown in FIG. 4, with respect to developer bias $V_B$ and grid voltage $V_G$. FIGS. 10A through 10C are graphs showing each of Jacobian matrixes $J_{GL}$, $J_{GM}$, and $J_{GH}$ with respect to the developer bias $V_B$ and the grid voltage $V_G$.

Inclinations of Jacobian matrixes $J_{BL}$, $J_{BM}$, and $J_{BH}$ with respect to the developer bias $V_B$ are negative and the inclinations of Jacobian matrixes $J_{BL}$, $J_{BM}$, and $J_{BH}$ with respect to the grid voltage $V_G$ are positive. The inclinations of Jacobian matrixes $J_{GL}$, $J_{GM}$, and $J_{GH}$ with respect to the developer bias $V_B$ are positive and the inclinations of Jacobian matrixes $J_{GL}$, $J_{GM}$, and $J_{GH}$ with respect to the grid voltage $V_G$ are negative.

Operation 217 of obtaining gain matrixes $G_B$ and $G_G$ will now be described in detail to obtain control input values $\Delta V_B$ and $\Delta V_G$.

In operation 213, the deviation $\Delta\Phi$ of the TRC values is represented by equation 10 and an increment $\Delta u$ defined by equation 23 is set from the deviation $\Delta\Phi$ and reversed matrixes of the Jacobian matrixes:

$$\Delta u=-J^{-1}\cdot\Delta\Phi \tag{23}$$

$$\text{where } \Delta u=\begin{bmatrix}\Delta V_B\\ \Delta V_G\end{bmatrix}=\begin{bmatrix}V_B(k+1)-V_B(k)\\ V_G(k+1)-V_G(k)\end{bmatrix},$$

$$J=\begin{bmatrix}J_{BL}(k)J_{GL}(k)\\ J_{BM}(k)J_{GM}(k)\\ J_{BH}(k)J_{GH}(k)\end{bmatrix},$$

$$\text{and } \Delta\Phi=\Phi(K)-\Phi_R \text{ where } \Phi(k)=\begin{bmatrix}\Phi(k)_L\\ \Phi(k)_M\\ \Phi(k)_H\end{bmatrix}$$

$$\text{and } \Phi_R=\begin{bmatrix}\Phi_{RK}\\ \Phi_{RM}\\ \Phi_{RH}\end{bmatrix}.$$

Equation 24 for the deviation $\Delta\Phi$ can be deduced from equation 23.

$$\Delta\Phi=-J\cdot\Delta u=-[J_BJ_G]\cdot\begin{bmatrix}\Delta V_B\\ \Delta V_G\end{bmatrix}=-J_B\Delta V_B-J_G\Delta V_G=\Delta\Phi_B+\Delta\Phi_G \tag{24}$$

where $\Delta\Phi_B=-J_B\cdot\Delta V_B$ and $\Delta\Phi_G\cdot\Delta V_G$.

Equation 25 is obtained by introducing a control parameter "a" to obtain an optimum solution.

$$\Delta\Phi_B=(1-a)\cdot\Delta\Phi=-J_B\cdot\Delta V_B$$

$$\Delta\Phi_G=a\cdot\Delta\Phi=-J_G\cdot\Delta V_B \tag{25}$$

The gain matrix values $G_B$ and $G_G$ represented utilizing equation 25 in operation 217 may be calculated by equation 26:

$$V_B(k+1)=V_B(k)-(J_B^T\cdot J_B)^{-1}\cdot J_B^T\cdot\Delta\Phi_B=V_B(k)-G_B\cdot\Delta\Phi_B$$

$$V_G(k+1)=V_G(k)-(J_G^T\cdot J_G)^{-1}\cdot J_G^T\cdot\Delta\Phi_G=V_G(k)-G_G\cdot\Delta\Phi_G \tag{26}$$

where $G_B=(J_B^T\cdot J_B)^{-1}\cdot J_B^T$ and $G_G=(J_G^T\cdot J_G)^{-1}\cdot J_G^T$.

Control input values $\Delta_{VB}$ and $\Delta_{VG}$ are calculated from the gain matrix values $G_B$ and $G_G$, the new developer bias control parameter ($V_B(k+1)$) and the new grid voltage control parameter ($V_G(k+1)$) are obtained from the gain matrix values $G_B$ and $G_G$, and the backplating vector $V_{BP}$ is calculated in operation 218.

Figure 8A:
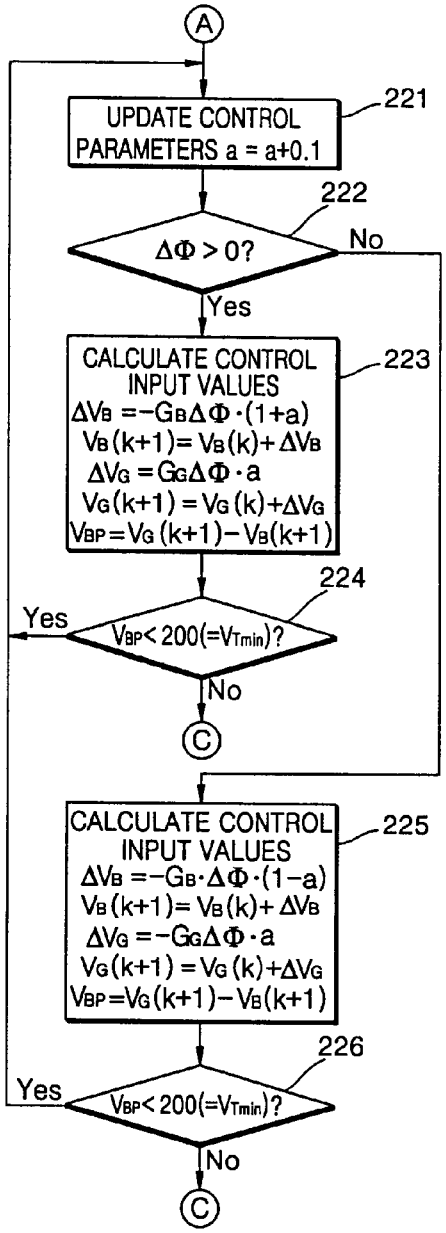
FIGS. 8A and 8B are flowcharts of operations A and B of the method of FIG. 7.
Figure 8B:
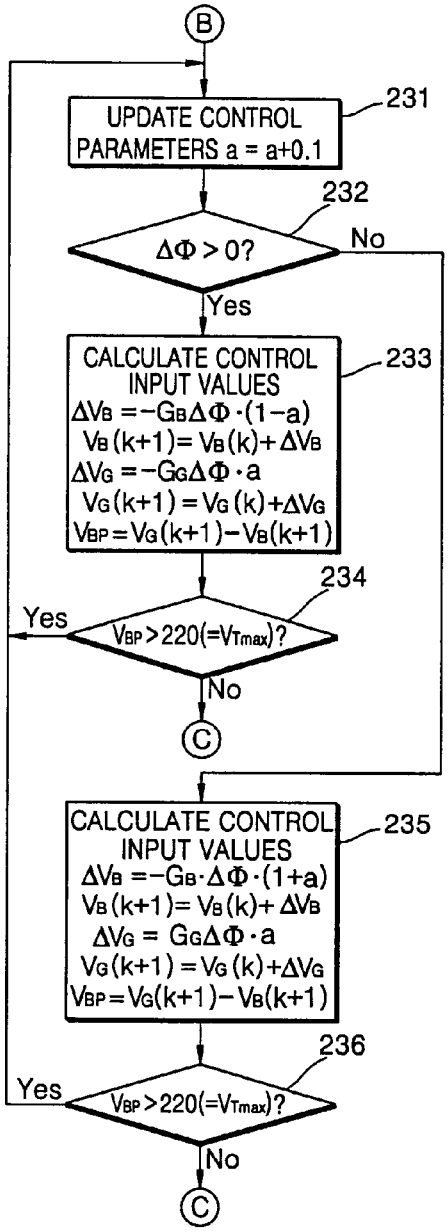

A control parameter "a" is initialized as "0" in operation 219. The backplating vector $V_{BP}$ is compared with a predetermined threshold voltage, e.g., a minimum threshold voltage $V_{Tmin}$=200V within a range of 200–220V in operation 220. If the backplating vector $V_{BP}$ is smaller than the minimum threshold voltage, operation A of FIG. 8A is performed. If the backplating vector $V_{BP}$ is greater than the minimum threshold voltage, operation B of FIG. 8B is performed.

In a case where it goes from operation 220 to operation A, the control parameter "a" is updated by equation 27 after operation 221. The increment "α" in equation 14 is 0.1 in equation 27, and can be set to another values according to the setting of an algorithm.

$$a=a+0.1 \tag{27}$$

It is determined whether the deviation $\Delta\Phi$ is greater or smaller than zero in operation 222. If the deviation $\Delta\Phi$ is greater than zero, control input values $\Delta_{VB}$ and $\Delta_{VG}$ are calculated by equation 15 in operation 223. If the deviation $\Delta\Phi$ is smaller than zero, the control input values $\Delta V_B$ and $\Delta V_G$ are calculated by equation 16 in operation 225. Thereafter, the backplating vector $V_{BP}$ is calculated.

It is determined whether the backplating vector $V_{BP}$ is greater or smaller than 200 in operations 224 and 226. If the backplating vector $V_{BP}$ is smaller than 200, operation 221 is repeated. If the backplating vector $V_{BP}$ is greater than 200, operation C, i.e., operation 212, is repeated to execute a TRC control algorithm. In operation 214, the operation of the TRC control algorithm ends only if the deviation $\Delta\Phi$ is smaller than the tolerance $\Delta\Phi_T$.

If the process goes from operation 220 to operation B, the control parameter "a" is updated by equation 27 in operation 231.

It is determined whether the deviation $\Delta\Phi$ is greater or smaller than zero in operation 232. If the deviation $\Delta\Phi$ is greater than zero, the control input values $\Delta V_B$ and $\Delta V_G$ are calculated by equation 17 in operation 233. If the deviation $\Delta\Phi$ is smaller than zero, the control input values $\Delta V_B$ and $\Delta V_G$ are calculated by equation 18 in operation 235. Thereafter, the backplating vector $V_{BP}$ is calculated.

It is determined whether the backplating vector $V_{BP}$ is greater or smaller than a maximum threshold voltage $V_{Tmax}$ 220 in operations 234 and 236. If the backplating vector $V_{BP}$ is greater than the maximum threshold voltage $V_{Tmax}$ 220, operation 231 is repeated. If the backplating vector $V_{BP}$ is smaller than the maximum threshold voltage $V_{Tmax}$ 220, operation C, i.e., operation 212 is repeated to execute the TRC control algorithm. In operation 214, the operation of the TRC control algorithm ends only if the deviation $\Delta\Phi$ is smaller than the tolerance $\Delta\Phi_T$.

Figure 11A:
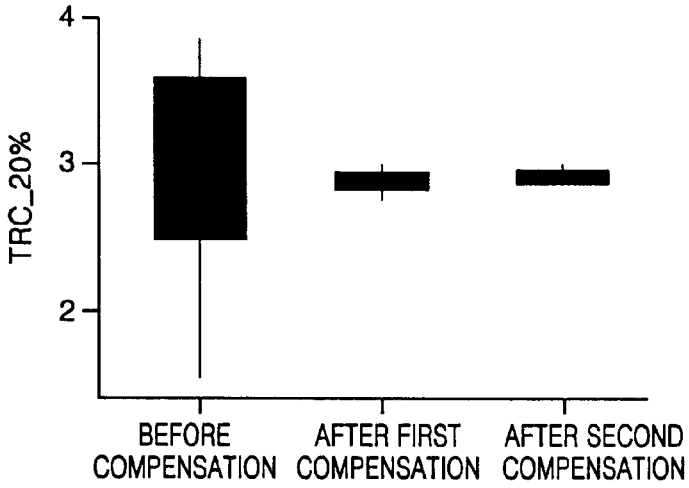
FIGS. 11A through 11C are graphs illustrating effects occurring by comparing TRC deviations before and after compensations when toner area coverage is 20%, 50%, and 80%, respectively, in the method of FIGS. 7 through 8B.
Figure 11B:
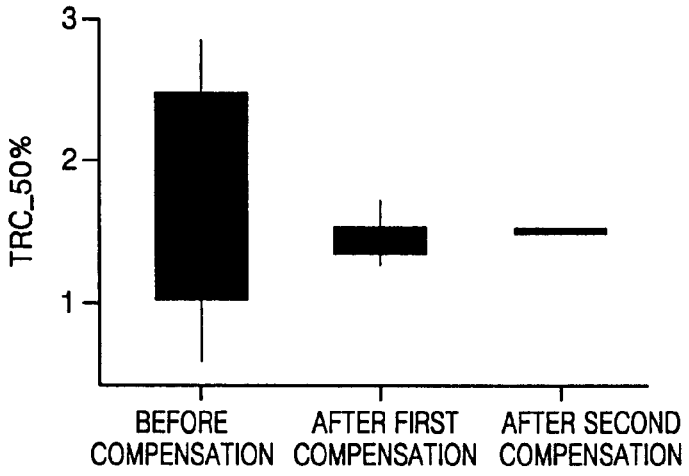
Figure 11C:
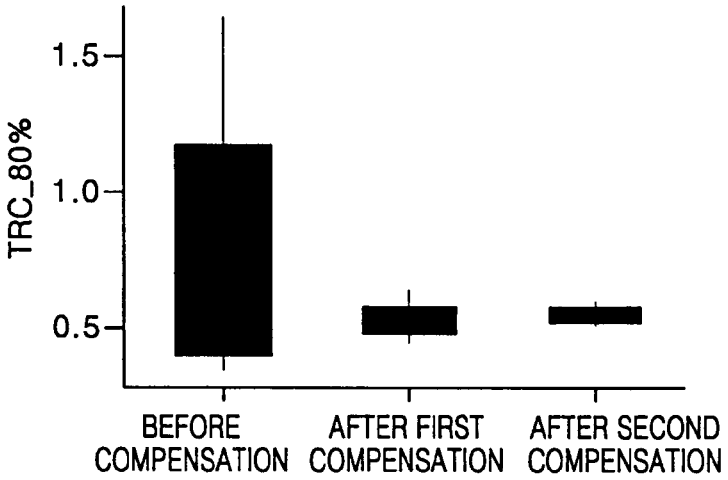
Figure 12:
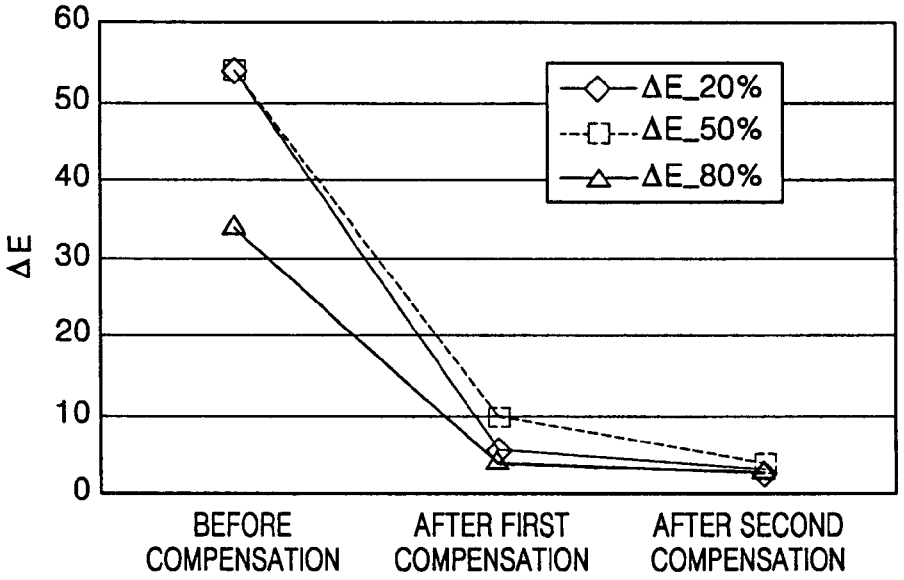
FIG. 12 is a graph illustrating effects by comparing $\Delta E$ deviations before and after compensations when toner area coverage 20%, 50%, and 80%, respectively, in the method of FIGS. 7 through 8B.

FIGS. 11A through 11C show whether the TRC value converges to the RTRC value when the developer bias $V_B$ and the grid voltage $V_G$ are artificially changed to verify the TRC control algorithm of the method of compensating for the image quality according to the second embodiment of the present invention and the TRC control algorithm is applied when the deviation $\Delta\Phi$ between the TRC and the RTRC is measured. FIG. 12 shows changes of color correspondence $\Delta E$ before and after compensations of the image quality.

FIGS. 11A through 11C are graphs showing a distribution of the measured TRC values before compensation and after first and second compensations using box plot when the toner area coverage is 20%, 50%, and 80%, respectively. In FIGS. 11A through 11C, it can be seen that the TRC deviations of respective toner area coverage are considerably reduced after the first compensation compared to the TRC deviation before compensation, are more reduced than the TRC deviation after the second compensation, and finally become close to the RTRC value.

FIG. 12 is a graph showing changes of a color correspondence $\Delta E$ calculated by equation 28.

$$\Delta E=((\Delta L^*)^2+(\Delta a^*)^2+(\Delta b^*)^2)^{1/2} \tag{28}$$

Where $\Delta L^*$ is obtained from $\Delta L^*$ $\Delta L^*=L^*_O-L^*_T$ and represents lightness, $\Delta a^*$ is obtained from $\Delta a^*=a^*_O-a^*_T$ and represents red-greeness, and $\Delta b^*$ is obtained from $\Delta b^*=b^*_O-b^*_T$ and represents a deviation of yellow-blueness that can be obtained from CIE Lab color coordinates and from differences between measurement values $L_O^*$, $a_O^*$, and $b_O^*$ and target values $L^{T*}$, $a^{T*}$, and $b^{T*}$.

In FIG. 12, it can be seen that values of the color correspondence $\Delta E$ are all less than 6 before and after second compensations when the toner area coverage 20%, 50%, and 80%, respectively, and thus an input image is almost correspond with an output image.

In a method of compensating image quality according to an embodiment of the present invention, an algorithm for measuring a TRC value using a CTD sensor and comparing the TRC value with a RTRC value is suggested. However, the developed mass (D) can be set to internal process parameters instead of the TRC value to execute a similar algorithm so as to compensate for the image quality. In this case, note that the TRC is inversely proportional to the developed mass (D).

Also, the CTD sensor measures DMA or TRC on test patches on a photosensitive belt, and an algorithm for controlling the DMA or TRC is suggested to reduce errors which may be caused by noise containable in the DMA or TRC. Further, backplating vectors are set to internal process parameters so as to be easily controlled. Processes of increasing the developer bias and the grid voltage to calculate the backplating parameters (vector) are adopted to form an output image which almost corresponds with an input image. As a result, the image quality of a printing machine can effectively be compensated.

Many contents have been described in detail, but must be interpreted as examples of preferred embodiments of the present invention not as being restricted to the scope of the present invention. In particular, one of ordinary skill in the art can properly adjust levels of input values and output values to the printing machine to obtain a specific equation of the TRC during an experiment so as to obtain a coefficient of the specific equation. Therefore, the scope of the present invention must be defined by the appended claims not the described preferred embodiments.

As described above, the method of compensating image quality according to the present invention has the following advantages. Noise components containable in measured values can be excluded by controlling the TRC so that noise components do not much affect image quality. Only the backplating vectors are set to the internal process parameters to easily compensate image quality. Moreover, an algorithm for sequentially increasing a developer bias and a grid voltage can be applied to provide a printed image close to an input image.

Although a few preferred embodiments of the present invention have been shown and described, it would be appreciated by those skilled in the art that changes may be made in this embodiment without departing from the principles and sprit of the invention, the scope of which is defined in the claims and their equivalents.

What is claimed is:

1. A method of compensating for image quality of a printing machine having a color toner density sensor, which is provided over a photosensitive belt, receiving light reflected from test patches having different toner area coverage and converting the received light to an electrical signal to control a developer bias $V_B$ and a grid voltage $V_G$, the method comprising:

(a) comparing a toner reproduction curve $\Phi(k)$ measured by the color toner density sensor with a target toner reproduction curve TRC $\Phi_R$ to obtain a deviation $\Delta\Phi$;

(b) calculating a variation $\Delta V_B$ of the developer bias $V_B$ from a Jacobian matrix ($J_B$) of a measured developer bias $V_{BO}$ to calculate a developer bias control parameter $V_{BN}$ and determining a measured grid voltage $V_{GO}$ as a grid voltage control parameter $V_{GN}$ if the deviation ($\Delta\Phi$) is greater than tolerance $\Delta\Phi_T$;

(c) obtaining a backplating vector $V_{BP}$ from the grid voltage control parameter $V_{GN}$ and the developer bias control parameter $V_{BN}$; and (d) comparing the backplating vector $V_{BP}$ with a critical value $V_T$ to set the developer bias and the grid voltage control parameters $V_{GN}$ and $V_{BN}$ to control the TRC $\Phi(k)$, the developer bias $V_B$ and a grid voltage $V_G$.

2. The method of claim 1, wherein the TRC comprises a plurality of TRCs $\Phi_{OL}$, $\Phi_{OM}$, and $\Phi_{OH}$ while the target TRC comprises a plurality of target TRCs $\Phi_{TL}$, $\Phi_{TM}$, and $\Phi_{TH}$, and the operation (a) comprises generating the deviation $\Delta\Phi$ from the following equation:

$$\Delta\Phi=|\Phi_O-\Phi_T|$$

$$\text{where } \Phi_o=\begin{bmatrix}\Phi_{OL}\\ \Phi_{OM}\\ \Phi_{OH}\end{bmatrix} \text{ and } \Phi_T=\begin{bmatrix}\Phi_{TL}\\ \Phi_{TM}\\ \Phi_{TH}\end{bmatrix}.$$

3. The method of claim 2, wherein operation (b) comprises:

(b-1) calculating the variation $\Delta V_B$ of the developer bias $V_B$, which satisfies equation below, from the Jacobian matrix $J_B$ of the measured developer bias $V_{BO}$;

$$\Delta V_B=-G_B\cdot\Delta\Phi$$

$$\text{wherein } G_B=(J_B^T\cdot J_B)^{-1}\cdot J_B^T \text{ where}$$

-continued $$J_B = \begin{bmatrix} J_{BL} \\ J_{BM} \\ J_{BH} \end{bmatrix} = \begin{bmatrix} 2A'_L V_B + F'_L V_G + C'_L \\ 2A'_M V_B + F'_M V_G + C'_M \\ 2A'_H V_B + F'_H V_G + C'_H \end{bmatrix} = \begin{bmatrix} \frac{\partial \Phi_{OL}}{\partial V_B} \\ \frac{\partial \Phi_{OM}}{\partial V_B} \\ \frac{\partial \Phi_{OH}}{\partial V_B} \end{bmatrix}$$

(b-2) setting the developer bias control parameter $V_{BN}$, which satisfies equation below, from the variation $\Delta V_B$ of the developer bias $V_B$; and $$V_{BN}=V_B+\Delta V_B$$

(b-3) determining the measured grid voltage $V_G$ as the grid voltage control parameter $V_{GN}$.

4. The method of claim 3, wherein operation (c) comprises calculating the backplating vector $V_{BP}$, which satisfies equation below, from the grid voltage control parameter $V_{GN}$ and the developer bias control parameter $V_{BN}$, $$V_{BP}=V_{GN}-V_{BN}.$$

5. The method of claim 4, wherein operation (d) comprise:

(d-1) determining the grid voltage control parameter $V_{GN}$ and the developer bias control parameter $V_{BN}$ in operation (c) as control parameters if the backplating vector $V_{BP}$ is greater than the critical value $V_T$;

(d-2) calculating the developer bias control parameter $V_{BN}$ and the grid voltage control parameter $V_{GN}$, which satisfy equation below, from the Jacobian matrix $J_B$ of the measured developer bias $V_{BO}$, the Jacobian matrix $J_G$ of the measured grid voltage $V_{GO}$, and a control parameter C if the backplating vector $V_{BP}$ is smaller than the critical value $V_T$;

$$V_{BN}=V_B+\Delta V_B$$

$$V_{GN}=V_G+\Delta V_G$$

wherein $\Delta V_B=-G_B\cdot\Delta\Phi\cdot(I+C)$ and $\Delta V_G=-G_G\cdot\Delta\Phi\cdot C$ where $G_G=(J_G^T\cdot J_G)^{-1}\cdot J_G^T$ $$\text{where } J_G = \begin{bmatrix} J_{GL} \\ J_{GM} \\ J_{GH} \end{bmatrix} = \begin{bmatrix} 2B'_L V_G + E'_L V_V + D'_L \\ 2B'_M V_G + E'_M V_B + D'_M \\ 2B'_H V_G + E'_H V_B + D'_H \end{bmatrix} = \begin{bmatrix} \frac{\partial \Phi_{OL}}{\partial V_G} \\ \frac{\partial \Phi_{OM}}{\partial V_G} \\ \frac{\partial \Phi_{OH}}{\partial V_G} \end{bmatrix}$$

(d-3) increasing the control parameter C by an increment a so as to satisfy equation below if the backplating vector $V_{BP}$ is smaller than the critical value $V_T$;

$$C=C+\alpha$$

(d-4) repeating operation (d-3) until the backplating vector $V_{BP}$ becomes greater than the critical value $V_T$; and (d-5) determining the grid voltage control parameter $V_{GN}$ and the developer bias control parameter $V_{BN}$ as new control parameters $V_{GN}$ and $V_{BN}$ when the backplating vector $V_{BP}$ is greater than the critical value $V_T$.

6. A method of compensating for image quality of an printing machine having a color toner density sensor, which is provided over a photosensitive belt, receiving light reflected from test patches having different toner area coverage and converting the received light into an electrical signal to control a developer bias and a grid voltage, the method comprising:

(a) comparing a toner reproduction curve (TRC) $\Phi(k)$ measured by the color toner density sensor with a reference TRC $\Phi_R$ to obtain a deviation $\Delta\Phi$;

(b) calculating the variation $\Delta V_B$ of the developer bias $V_B(k)$ from a Jacobian matrix $J_B$ of a measured developer bias $V_B(k)$ to calculate a new developer bias control parameter $V_B(k+1)$ and determining a measured grid voltage $V_G(k)$ as a new grid voltage control parameter $V_G(k+1)$ if the deviation $\Delta\Phi$ is not less than tolerant deviation $\Delta\Phi_T$;

(c) obtaining a backplating vector $V_{BP}$ from a difference between the grid voltage control parameter $V_G(k+1)$ and the developer bias control parameter $V_B(k+1)$; and (d) initializing a control parameter "a" as "0", comparing the backplating vector $V_{BP}$ with a minimum critical value $V_{Tmin}$, performing operation (e) if the backplating vector $V_{BP}$ is smaller than the minimum critical value $V_{Tmin}$, and performing operation (g) if the backplating vector $V_{BP}$ is greater than the minimum critical value $V_{Tmin}$;

(e) increasing the control parameter "a" by an increment "α", setting control parameters $V_G(k+1)$ and $V_B(k+1)$ based on an amount of the deviation $\Delta\Phi$, obtaining the backplating vector $V_{BP}$ from a difference between the grid voltage control parameter $V_G(k+1)$ and the developer bias control parameter $V_B(k+1)$, and performing operation (f);

(f) repeating operation (e) if the backplating vector $V_{BP}$ is smaller than the minimum critical value $V_{Tmin}$, and repeating operations (a) through (e) if the backplating vector $V_{BP}$ is greater than the minimum critical value $V_{Tmin}$;

(g) increasing the control parameter "a" by the increment "α", setting the developer bias and grid voltage control parameters $V_G(k+1)$ and $V_B(k+1)$ based on the amount of the deviation $\Delta\Phi$, obtaining the backplating vector $V_{BP}$ from a difference between the the developer bias and grid voltage control parameters $V_G(k+1)$ and $V_B(k+1)$, and performing operation (h); and (h) repeating operation (g) if the backplating vector $V_{BP}$ is greater than a maximum critical value $V_{Tmax}$, and repeating steps (a) through (g) if the backplating vector $V_{BP}$ is smaller than a maximum critical value $V_{Tmax}$.

7. The method of claim 6, wherein operation (a) comprises calculating the deviation $\Delta\Phi$ satisfying the following equation;

$$\Delta\Phi=\Phi(k)-\Phi_R$$

$$\text{where } \Phi(k) = \begin{bmatrix} \Phi(k)_L \\ \Phi(k)_M \\ \Phi(k)_H \end{bmatrix} \text{ and } \Phi_R = \begin{bmatrix} \Phi_{RL} \\ \Phi_{RM} \\ \Phi_{RH} \end{bmatrix}.$$

8. The method of claim 7, wherein operation (b) comprises:

(b-1) calculating the variation $\Delta V_B$ of the developer bias $V_B(k)$, which satisfies equation below, from the Jacobian matrix $J_B$ of the measured developer bias $V_B(k)$;

$$\Delta V_B=-G_B\cdot\Delta\Phi$$

wherein $G_B = (J_B^T \cdot J_B)^{-1} \cdot J_B^T$ where $$J_B = \begin{bmatrix} J_{BL} \\ J_{BM} \\ J_{BH} \end{bmatrix} = \begin{bmatrix} 2A_L V_B + E_L V_G + C_L \\ 2A_M V_B + E_M V_G + C_M \\ 2A_H V_B + E_H V_G + C_H \end{bmatrix} = \begin{bmatrix} \frac{\partial \Phi(k)_L}{\partial V_B} \\ \frac{\partial \Phi(k)_M}{\partial V_B} \\ \frac{\partial \Phi(k)_H}{\partial V_B} \end{bmatrix}$$

(b-2) setting the new developer bias control parameter $V_B(k+1)$, which satisfies equation below, from the variation $\Delta V_B$ of the developer bias $V_B$; and $$V_B(k+1)=V_B(k)+\Delta V_B$$

(b-3) determining the measured grid voltage $V_G(k)$ as the new grid voltage control parameter $V_{GN}(k+1)$.

9. The method of claim 8, wherein operation (c) comprises calculating the backplating vector $V_{BP}$, which satisfies equation below, from the grid voltage control parameter $V_G(k+1)$ and the developer bias control parameter $V_B(k+1)$, $$V_{BP}=V_G(k+1)-V_B(k+1).$$

10. The method of claim 9, wherein operation (d) comprises initializing the control parameter "a" as "0".

11. The method of claim 10, wherein operation (e) comprises:

(e-1) increasing the control parameter "a" by an increment "α";

$$a=a+\alpha$$

(e-2) setting the control parameters $V_G(k+1)$ and $V_B(k+1)$ that satisfies equation below to obtain the backplating vector $V_{BP}$ from a difference between the grid voltage control parameter $V_G(k+1)$ and the developer bias control parameter $V_B(k+1)$ if the deviation $\Delta\Phi$ is negative and then going to step (f); and $$V_B(k+1)=V_B(k)+\Delta V_B$$

$$V_G(k+1)=V_G(k)+\Delta V_G$$

$$V_{BP}=V_G(k+1)-V_B(k+1)$$

wherein $\Delta V_B = -G_B \cdot \Delta\Phi \cdot (1+a)$ and $\Delta V_G = G_G \cdot \Delta\Phi \cdot a$, where $G_G=(J_G^T \cdot J_G)^{-1} \cdot J_G^T$, $$\text{where } J_G = \begin{bmatrix} J_{GL} \\ J_{GM} \\ J_{GH} \end{bmatrix} = \begin{bmatrix} 2B_L V_G + E_L V_B + D_L \\ 2B_M V_G + E_M V_B + D_M \\ 2B_H V_G + E_H V_G + D_H \end{bmatrix} = \begin{bmatrix} \frac{\partial \Phi(k)_L}{\partial V_G} \\ \frac{\partial \Phi(k)_M}{\partial V_G} \\ \frac{\partial \Phi(k)_H}{\partial V_G} \end{bmatrix},$$

(e-3) setting the control parameters $V_G(k+1)$ and $V_B(k+1)$ that satisfy equation below to obtain the backplating vector $V_{BP}$ from the difference between the grid voltage control parameter $V_G(k+1)$ and the developer bias control parameter $V_B(k+1)$ if the deviation $\Delta\Phi$ is positive and then performing operation (f); and $$V_B(k+1)=V_B(k)+\Delta V_B$$

$$V_G(k+1)=V_G(k)+\Delta V_G$$

$$V_{BP}=V_G(k+1)-V_B(k+1)$$

wherein $\Delta V_B = -G_B \cdot \Delta\Phi \cdot (1-\alpha)$ and $\Delta V_G = -G_G \cdot \Delta\Phi \cdot \alpha$ where $G_G=(J_G^T \cdot J_G)^{-1} \cdot J_G^T$, $$\text{where } J_G = \begin{bmatrix} J_{GL} \\ J_{GM} \\ J_{GH} \end{bmatrix} = \begin{bmatrix} 2B_L V_G + E_L V_B + D_L \\ 2B_M V_G + E_M V_B + D_M \\ 2B_H V_G + E_H V_G + D_H \end{bmatrix} = \begin{bmatrix} \frac{\partial \Phi(k)_L}{\partial V_G} \\ \frac{\partial \Phi(k)_M}{\partial V_G} \\ \frac{\partial \Phi(k)_H}{\partial V_G} \end{bmatrix}.$$

12. The method of claim 10, wherein operation (g) comprises:

(g-1) increasing the control parameter "a" by the increment "α";

(g-2) setting the control parameters $V_G(k+1)$ and $V_B(k+1)$ that satisfy equation below to obtain the backplating vector $V_{BP}$ from the difference between the grid voltage control parameter $V_G(k+1)$ and the developer bias control parameter $V_B(k+1)$ if the deviation ($\Delta\Phi$) is negative and then going to step (h); and $$V_B(k+1)=V_B(k)+\Delta V_B$$

$$V_G(k+1)=V_G(k)+\Delta V_G$$

$$V_{BP}=V_G(k+1)-V_B(k+1)$$

wherein $\Delta V_B = -G_B \cdot \Delta\Phi \cdot (1-a)$ and $\Delta V_G = -G_G \cdot \Delta\Phi \cdot a$ where $G_G=(J_G^T \cdot J_G)^{-1} \cdot J_G^T$, $$\text{where } J_G = \begin{bmatrix} J_{GL} \\ J_{GM} \\ J_{GH} \end{bmatrix} = \begin{bmatrix} 2B_L V_G + E_L V_B + D_L \\ 2B_M V_G + E_M V_B + D_M \\ 2B_H V_G + E_H V_G + D_H \end{bmatrix} = \begin{bmatrix} \frac{\partial \Phi(k)_L}{\partial V_G} \\ \frac{\partial \Phi(k)_M}{\partial V_G} \\ \frac{\partial \Phi(k)_H}{\partial V_G} \end{bmatrix}$$

(g-3) setting the control parameters $V_G(k+1)$ and $V_B(k+1)$ that satisfy equation below to obtain the backplating vector $V_{BP}$ from the difference between the grid voltage control parameter $V_G(k+1)$ and the developer bias control parameter $V_B(k+1)$ if the deviation $\Delta\Phi$ is positive and then performing operation (f); and $$V_B(k+1)=V_B(k)+\Delta V_B$$

$$V_G(k+1)=V_G(k)+\Delta V_G$$

$$V_{BP}=V_G(k+1)-V_B(k+1)$$

wherein $\Delta V_B = -G_B \cdot \Delta\Phi \cdot (1+a)$ and $\Delta V_G = -G_G \cdot \Delta\Phi \cdot a$, where $G_G=(J_G^T \cdot J_G)^{-1} \cdot J_G^T$, and where $$J_G = \begin{bmatrix} J_{GL} \\ J_{GM} \\ J_{GH} \end{bmatrix} = \begin{bmatrix} 2B_L V_G + E_L V_B + D_L \\ 2B_M V_G + E_M V_B + D_M \\ 2B_H V_G + E_H V_G + D_H \end{bmatrix} = \begin{bmatrix} \frac{\partial \Phi(k)_L}{\partial V_G} \\ \frac{\partial \Phi(k)_M}{\partial V_G} \\ \frac{\partial \Phi(k)_H}{\partial V_G} \end{bmatrix}.$$

13. A method of compensating for image quality of a printing machine having a color toner density sensor receiving light reflected from test patches having different toner area coverage and converting the received light into a toner reproducing curve (TRC) value to control a developer bias and a grid voltage, the method comprising:

comparing the TRC value with a target TRC to obtain a deviation;

comparing the deviation with a reference value;

calculating a developer bias control parameter and a grid voltage control parameter from a measured developer bias, a measured grid voltage, and the deviation;

calculating a backplating vector from the developer bias control parameter and the grid voltage control parameter;

comparing the backplating vector with a second reference value; and determining the developer bias control parameter and the grid voltage control parameter as new control parameters to control the developer bias and the grid voltage when the backplating vector is greater than the second reference value.

14. The method of claim 13, wherein the determining of the developer bias control parameter and the grid voltage control parameter comprises:

modifying the developer bias control parameter and the grid voltage control parameter to a second developer bias control parameter and a second grid voltage control parameter when the backplating vector is not greater than the second reference value.

15. The method of claim 14, wherein the modifying of the developer bias control parameter and the grid voltage control parameter comprises:

generating the second developer bias control parameter in accordance with a gain coefficient, a control coefficient, the deviation, and the developer bias.

16. The method of claim 15, wherein the modifying of the developer bias control parameter and the grid voltage control parameter comprises:

increasing the control coefficient by a predetermined amount when the modifying of the developer bias control parameter and the grid voltage control parameter is performed.

17. The method of claim 15, wherein the modifying of the developer bias control parameter and the grid voltage control parameter comprises:

calculating the second developer bias control parameter by using the following formula:

(the second developer bias control parameter)=(the developer bias−the gain coefficient*the deviation*the control parameter).

18. The method of claim 15, wherein the modifying of the developer bias control parameter and the grid voltage control parameter comprises:

generating the second grid voltage control parameter in accordance with the grid voltage and a control input value obtained from the deviation and a control coefficient.

19. The method of claim 18, wherein the modifying of the developer bias control parameter and the grid voltage control parameter comprises:

increasing the control coefficient by a predetermined amount when the modifying of the developer bias control parameter and the modifying of the grid voltage control parameter are repeated.

20. The method of claim 18, wherein the modifying of the developer bias control parameter and the grid voltage control parameter comprises:

calculating the second grid voltage control parameter by using the following formula:

(the second grid voltage control parameter)=(the grid voltage+the gain coefficient*the deviation*the control parameter).

21. The method of claim 14, wherein the determining of the developer bias control parameter and the grid voltage control parameter comprises:

calculating a second backplating vector from the second developer bias control parameter and the second grid voltage control parameter; and comparing the second backplating vector with a second reference value.

22. The method of claim 14, wherein the determining of the developer bias control parameter and the grid voltage control parameter comprises:

determining the second developer bias control parameter and the second grid voltage control parameter as the new control parameters to control the developer bias and the grid voltage when the second backplating vector is greater than the second reference value.

23. The method of claim 13, wherein the TRC comprises a plurality of TRCs while the target TRC comprises a plurality of taget TRCs, and the comparing of the TRC value with the target TRC comprises:

calculating the deviation from the TRCs and the target TRCs by using a Jacobian matrix.

24. The method of claim 13, wherein the calculating of the developer bias control parameter and the grid voltage control parameter comprises:

calculating the developer bias control parameter in accordance with the deviation, the measured developer bias, a gain coefficient, and a control input value obtained from the gain coefficient and the deviation.

25. The method of claim 13, wherein the calculating of the developer bias control parameter and the grid voltage control parameter comprises:

calculating the grid voltage control parameter in accordance with the deviation, the measured grid bias, a gain coefficient, and a control input value obtained from the gain coefficient and the deviation.

26. The method of claim 13, wherein the calculating of the developer bias control parameter and the grid voltage control parameter comprises:

setting a control input value obtained from a gain coefficient and the deviation; and calculating the grid voltage control parameter in accordance with the control input value and the grid voltage.

27. The method of claim 26, wherein the calculating of the developer bias control parameter and the grid voltage control parameter comprises:

setting the control input value as zero; and calculating the grid voltage control parameter in accordance with the control input value and the grid voltage.

28. The method of claim 13, wherein the calculating of the developer bias control parameter and the grid voltage control parameter comprises:

setting the grid voltage as the grid voltage control parameter.

29. The method of claim 13, wherein the comparing of the backplating vector with the second reference value comprises:

comparing the backplating vector with a minimum value; and generating a second developer bias control parameter and a second grid voltage control parameter in accordance with a gain coefficient, a control coefficient, the deviation, the developer bias, and the grid voltage when the backplating vector is less than the minimum value.

30. The method of claim 29, wherein the comparing of the backplating vector with the second reference value comprises:

generating a second backplating vector in response to the second developer bias control parameter and the second grid voltage control parameter.

31. The method of claim 30, wherein the comparing of the backplating vector with the second reference value comprises:

repeating operations of comparing the TRC value with a target TRC, comparing the deviation with the reference value, calculating the developer bias control parameter and the grid voltage control parameter, calculating the second backplating vector when the second backplating vector is greater than the minimum value.

32. The method of claim 29, wherein the comparing of the backplating vector with the second reference value comprises:

increasing the control coefficient by a predetermined amount whenever the deviation is greater than a predetermined deviation value.

33. The method of claim 29, wherein the comparing of the backplating vector with the second reference value comprises:

decreasing the control coefficient by a predetermined amount whenever the deviation is less than a predetermined deviation value.

34. The method of claim 29, wherein the comparing of the backplating vector with the second reference value comprises:

comparing the backplating vector with a maximum value; and generating a second developer bias control parameter and a second grid voltage control parameter in accordance with a gain coefficient, a control coefficient, the deviation, the developer bias, and the grid voltage when the backplating vector is less than the minimum value.

35. The method of claim 34, wherein the comparing of the backplating vector with the second reference value comprises:

generating a second backplating vector in response to the second developer bias control parameter and the second grid voltage control parameter; and repeating operations of comparing the TRC value with a target TRC, comparing the deviation with the reference value, calculating the developer bias control parameter and the grid voltage control parameter, calculating the second backplating vector when the second backplating vector is less than the maximum value.

* * * * *

UNITED STATES PATENT AND TRADEMARK OFFICE

CERTIFICATE OF CORRECTION

PATENT NO. : 6,687,470 B2
DATED : February 3, 2004
INVENTOR(S) : Woo-jung Shim et al.

It is certified that error appears in the above-identified patent and that said Letters Patent is hereby corrected as shown below:

Column 16,
Line 47, after “and” start a new paragraph

Column 17,
Line 53, change “a” to -- α --

Column 22,
Line 20, change “taget” to -- target --

Signed and Sealed this

Sixth Day of July, 2004

JON W. DUDAS
*Acting Director of the United States Patent and Trademark Office*